US007484833B2

(12) United States Patent
Kim et al.

(10) Patent No.: US 7,484,833 B2
(45) Date of Patent: Feb. 3, 2009

(54) DROPLET EJECTOR AND INK-JET PRINTHEAD USING THE SAME

(75) Inventors: Min-soo Kim, Seoul (KR); Suk-han Lee, Yongin-si (KR); Yong-soo Oh, Seongnam-si (KR); Keon Kuk, Yongin-si (KR); Seung-joo Shin, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 282 days.

(21) Appl. No.: 10/760,276

(22) Filed: Jan. 21, 2004

(65) Prior Publication Data

US 2004/0150694 A1 Aug. 5, 2004

(30) Foreign Application Priority Data

Jan. 21, 2003 (KR) ..... 10-2003-0004105

(51) Int. Cl.
*B41J 2/04* (2006.01)
*B41J 2/05* (2006.01)
*B41J 2/045* (2006.01)

(52) U.S. Cl. ..... 347/57; 347/54; 347/68

(58) Field of Classification Search ..... 347/48, 347/54, 57, 68
See application file for complete search history.

(56) References Cited

U.S. PATENT DOCUMENTS 5,515,085 A * 5/1996 Hotomi et al. ..... 347/54
5,856,837 A 1/1999 Kitahara et al. ..... 347/70
6,139,132 A * 10/2000 Yasukawa et al. ..... 347/70
6,293,654 B1 9/2001 Pidwerbecki ..... 347/64
6,406,131 B2 6/2002 Lerat et al. ..... 347/54
6,726,312 B1 * 4/2004 Fujimura et al. ..... 347/68
2002/0060704 A1 * 5/2002 Suzuki ..... 347/5
2003/0122895 A1 * 7/2003 Torgerson et al. ..... 347/43

FOREIGN PATENT DOCUMENTS

JP 11-105276 4/1999
KR 00 250 358 B1 4/2000

OTHER PUBLICATIONS

Patent Abstracts of Japan, vol. 0143, No. 05 (M-0992) Jun. 29, 1990 & JP 2 099 386 A (Apr. 11, 1990).
Patent Abstracts of Japan, vol. 0140, No. 50 (P-0998), Jan. 30, 1990) & JP 1 277839 (Nov. 8, 1989).

* cited by examiner

*Primary Examiner*—K. Feggins
*Assistant Examiner*—Jannelle M Lebron
(74) *Attorney, Agent, or Firm*—Lee & Morse, P.C.

(57) ABSTRACT

In a droplet ejector and an ink-jet printhead using the same, the droplet ejector includes a fluid path through which a fluid moves, a nozzle being formed on one end of the fluid path, a volumetric structure formed in the fluid path, the volumetric structure being sensitive to an external stimulus and being capable of varying in size to eject a droplet of the fluid through the nozzle, and a stimulus generator, which applies a stimulus to the volumetric structure to vary a size of the volumetric structure.

38 Claims, 18 Drawing Sheets

DROPLET EJECTOR AND INK-JET PRINTHEAD USING THE SAME

BACKGROUND OF THE INVENTION

1. Field of the Invention

The present invention relates to a droplet ejector and an ink-jet printhead using the same. More particularly, the present invention relates to a droplet ejector that ejects ink droplets by expanding and contracting a volumetric structure sensitive to an external stimulus, and an ink-jet printhead using the same.

2. Description of the Related Art

Typically, ink-jet printheads are devices for printing a predetermined image, color or black, by ejecting a small volume droplet of printing ink at a desired position on a recording sheet. Ink-jet printheads are largely categorized into two types depending on which ink droplet ejection mechanism is used. A first type is a thermally driven ink-jet printhead in which a heat source is employed to form and expand bubbles in ink causing ink droplets to be ejected. A second type is a piezoelectrically driven ink-jet printhead in which a piezoelectric material deforms to exert pressure on ink causing ink droplets to be ejected.

Hereinafter, the ink ejection mechanism in the thermally driven ink-jet printhead will be described in greater detail. When a pulse current flows through a heater formed of a resistance heating material, the heater generates heat and ink adjacent to the heater is instantaneously heated to about 300° C., thereby boiling the ink. The boiling of the ink causes bubbles to be generated, expand, and apply pressure to an interior of an ink chamber filled with ink. As a result, ink near a nozzle is ejected from the ink chamber in droplet form through the nozzle.

The thermal driving method includes a top-shooting method, a side-shooting method, and a back-shooting method depending on a growth direction of bubbles and an ejection direction of ink droplets.

The top-shooting method is a method in which the growth direction of bubbles is the same as the ejection direction of ink droplets. The side-shooting method is a method in which the growth direction of bubbles is perpendicular to the ejection direction of ink droplets. The back-shooting method is a method in which the growth direction of bubbles is opposite to the ejection direction of ink droplets.

FIG. 1 illustrates a cross-sectional view of a structure of a conventional thermally driven ink-jet printhead. Referring to FIG. 1, the thermally driven ink-jet printhead includes a base plate 30 formed by a plurality of material layers stacked on a substrate, a barrier layer 40 that is formed on the base plate 30 and defines an ink chamber 42, and a nozzle plate 50 stacked on the barrier layer 40. Ink fills the ink chamber 42, and a heater 33 that heats ink to generate bubbles in ink is installed under the ink chamber 42. Although FIG. 1 illustrates a single exemplary nozzle 52, a plurality of nozzles 52 through which ink is ejected may be formed in a position corresponding to each of a plurality of ink chambers 42.

The vertical structure of the ink-jet printhead described above will now be described in greater detail.

An insulating layer 32 formed of silicon is formed on a substrate 31 for providing insulation between a heater 33 and the substrate 31. The insulating layer 32 is formed by depositing a silicon oxide layer on the substrate 31. The heater 33, which heats ink in the ink chamber 42 to generate bubbles in ink, is formed on the insulating layer 32. The heater 33 is formed by depositing tantalum nitride (TaN) or thin-film tantalum-aluminum (TaAl) on the insulating layer 32 in a thin film shape. A conductor 34 for applying a current to the heater 33 is formed on the heater 33. The conductor 34 is made of a metallic material having good conductivity, such as aluminum (Al) or an aluminum (Al) alloy. Specifically, the conductor 34 is formed by depositing aluminum (Al) on the heater 33 to a predetermined thickness and patterning a deposited resultant in a predetermined shape.

A passivation layer 35 for passivating the heater 33 and the conductor 34 is formed on the heater 33 and the conductor 34. The passivation layer 35 prevents the heater 33 and the conductor 34 from oxidizing or directly contacting ink, and is formed by depositing silicon nitride. In addition, an anti-cavitation layer 36, on which the ink chamber 42 is to be formed, is formed on the passivation layer 35. A top surface of the anti-cavitation layer 36 forms a bottom surface of the ink chamber 42 and prevents damage to the heater 33 due to a high pressure caused by bubble collapse in the ink chamber 42. A tantalum thin film is used as the anti-cavitation layer 36.

In this configuration, a barrier layer 40 defining the ink chamber 42 is stacked on the base plate 30 formed of the plurality of material layers stacked on the substrate 31. The barrier layer 40 is formed by coating a photosensitive polymer on the base plate 30 through lamination and patterning a coated resultant. In this case, the thickness of the photosensitive polymer is determined by the height of the ink chamber 42 corresponding to the volume of ink droplets.

A nozzle plate 50, in which the nozzle 52 is formed, is stacked on the barrier layer 40. The nozzle plate 50 is formed of polyimide or nickel (Ni) and is attached to the barrier layer 40 using an adhering property of a photosensitive polymer.

In the thermally driven ink-jet printhead, however, a heater is heated at a high temperature to generate bubbles in ink, such that energy efficiency is low and a remaining energy should be dissipated.

FIG. 2 illustrates a general structure of a piezoelectrically driven ink-jet printhead. Referring to FIG. 2, a reservoir 2, a restrictor 3, a pressure chamber 4, and a nozzle 5, which collectively form an ink passage, are formed in a passage formation plate 1. A piezoelectric actuator 6 is formed on the passage formation plate 1. In operation, the reservoir 2 stores ink flowing from an ink container (not shown), and the restrictor 3 is a path through which ink flows from the reservoir 2 to the pressure chamber 4. The pressure chamber 4 is filled with ink to be ejected, and the volume of the pressure chamber 4 is varied by driving the piezoelectric actuator 6, which causes a variation in pressure for ejection or flow of ink.

The passage formation plate 1 is formed by cutting a plurality of thin plates formed of ceramic, metal, or synthetic resin, forming part of the ink passage, and depositing the plurality of thin plates. The piezoelectric actuator 6 is formed above the pressure chamber 4 and has a structure in which a piezoelectric thin plate and an electrode for applying a voltage to the piezoelectric thin plate are stacked. In this configuration, a portion of the passage formation plate 1 that forms upper walls of the pressure chamber 4 serves as a vibration plate 1*a* deformed by the piezoelectric actuator 6.

The operation of the piezoelectrically driven ink-jet printhead having the above structure will now be described.

When the vibration plate 1*a* is deformed by driving the piezoelectric actuator 6, the volume of the pressure chamber 4 is reduced. Subsequently, due to a variation in pressure in the pressure chamber 4 caused by a reduction in the volume of the pressure chamber 4, ink in the pressure chamber 4 is ejected through the nozzle 5. Subsequently, when the vibration plate 1*a* is restored to an original shape by driving the piezoelectric actuator 6, the volume of the pressure chamber 4 is increased. Due to a variation in pressure caused by an increase in the volume of the pressure chamber 4, ink stored in the reservoir 2 flows into the pressure chamber 4 through the restrictor 3.

FIG. 3 illustrates a structure of a conventional piezoelectrically driven ink-jet printhead. FIG. 4 illustrates a cross-sectional view taken along line IV-IV of FIG. 3.

Referring to FIGS. 3 and 4, the piezoelectrically driven ink-jet printhead is formed by stacking a plurality of thin plates and adhering them to one another. More specifically, a first plate 11, in which a nozzle 11*a* through which ink is ejected is formed, is disposed in a lowermost portion of a printhead, a second plate 12, in which a reservoir 12*a* and an ink outlet 12*b* are formed, is stacked on the first plate 11, and a third plate 13, in which an ink inlet 13*a* and an ink outlet 13*b* are formed, is stacked on the second plate 12. A fourth plate 14, in which an ink inlet 14*a* and an ink outlet 14*b* are formed, is stacked on the third plate 13, and a fifth plate 15, in which a pressure chamber 15*a* in communication with the ink inlet 14*a* and the ink outlet 14*b* is formed, is stacked on the fourth plate 14. The ink inlets 13*a* and 14*a* serve as a path through which ink flows from the reservoir 12*a* to the pressure chamber 15*a*. The ink outlets 12*b*, 13*b*, and 14*b* serve as a path through which ink is expelled from the pressure chamber 15*a* toward the nozzle 11*a*. A sixth plate 16, which closes an upper portion of the pressure chamber 15*a*, is stacked on the fifth plate 15. A driving electrode 20, which is a piezoelectric actuator, and a piezoelectric thin film 21 are formed on the sixth plate 16. Thus, the sixth plate 16 serves as a vibration plate that vibrates by the piezoelectric actuator, and the volume of the pressure chamber 15*a* formed under the sixth plate 16 is varied by deformation of the vibration plate.

In general, the first, second, and third plates 11, 12, and 13 are molded by etching or press-finishing a metallic thin plate, and the fourth, fifth, and sixth plates 14, 15, and 16 are molded by cutting thin-plate-shaped ceramic. In the piezoelectrically driven ink-jet printhead having the above structure, however, in order to obtain an effective displacement of a piezoelectric thin film for ejection of ink droplets, a size of a structure becomes larger. As such, the number of nozzles per unit area is limited. In addition, in order to manufacture the piezoelectrically driven ink-jet printhead, a variety of plates are separately processed using a variety of processing methods, and then, the plates are stacked and adhered to one another. Thus, the plates should be precisely disposed and adhered.

FIGS. 5A and 5B illustrate a structure of another conventional ink-jet printhead.

Referring to FIGS. 5A and 5B, a nozzle 65*a* is formed on an end of a channel 65 filled with ink 60, and a polymer element 70 is formed around the nozzle 65*a*. The polymer element 70 may be in a hydrophilic or hydrophobic state according to a temperature value. In this configuration, a heating element 75 for providing temperature control is formed under the polymer element 70.

In the above structure, FIG. 5A illustrates an ink-jet printhead when the polymer element 70 is in a hydrophilic state. In this state, ink 60 contacts the polymer element 70 and stays in contact with the polymer element 70. However, if the heating element 75 increases the temperature of the polymer element 70 to more than a threshold temperature, as shown in FIG. 5B, the polymer element 70 is changed into a hydrophobic state. The threshold temperature is a phase transition temperature of a polymer. When the polymer element 70 is changed into the hydrophobic state, ink 60 is repelled from the polymer element 70. In this state, a predetermined pressure is applied to an ink supply unit 90. Thus, ink 60 is not returned to the ink supply unit 90 and is ejected in droplets through a nozzle 65*a* onto a sheet of paper 80.

Accordingly, this ink-jet printhead ejects ink droplets using a method of changing a polymer element in a hydrophobic or hydrophilic state depending on a temperature value.

However, unlike the above-described method, the present invention uses a method of ejecting ink droplets by expanding and contracting a volumetric structure sensitive to an external stimulus.

SUMMARY OF THE INVENTION

The present invention provides a droplet ejector that ejects ink droplets by expanding and contracting a volumetric structure sensitive to an external stimulus, and an ink-jet printhead using the same.

According to a feature of an embodiment of the present invention, there is provided a droplet ejector including a fluid path through which a fluid moves, a nozzle being formed on one end of the fluid path, a volumetric structure formed in the fluid path, the volumetric structure being sensitive to an external stimulus and being capable of varying in size to eject a droplet of the fluid through the nozzle, and a stimulus generator, which applies a stimulus to the volumetric structure to vary a size of the volumetric structure.

In an embodiment of the present invention, the volumetric structure expands in size to eject the droplet through the nozzle, and the stimulus generator applies the stimulus to the volumetric structure to expand the size of the volumetric structure.

In this embodiment, the volumetric structure may be formed of stimulus sensitive hydrogel, and the stimulus sensitive hydrogel may be electrical field sensitive hydrogel.

The fluid path may include a chamber, which is filled with the fluid to be ejected and is formed under the nozzle, and a channel for supplying the fluid to the chamber, wherein the volumetric structure is formed in the chamber.

The volumetric structure may have a columnar shape, a hexahedral shape, or a cylindrical shape.

The stimulus generator may be a pair of electrodes respectively disposed above and below the volumetric structure. In this case, one of the pair of electrodes is a cathode and is disposed above the volumetric structure.

The stimulus generator may be a pair of electrodes respectively disposed at either side of the volumetric structure.

In another embodiment of the present invention, the volumetric structure contracts in size to eject the droplet through the nozzle, and the stimulus generator applies the stimulus to the volumetric structure to contract the size of the volumetric structure.

In this embodiment, the volumetric structure may be formed of stimulus sensitive hydrogel, and the stimulus sensitive hydrogel may be temperature sensitive hydrogel.

The stimulus generator may be a resistance heating material for applying heat to the volumetric structure.

The fluid path may include a chamber, which is filled with the fluid to be ejected and is formed under the nozzle, and a channel for supplying the fluid to the chamber.

The volumetric structure may be formed in the channel. In this case, the volumetric structure may have a columnar shape or a hexahedral shape. The volumetric structure may be formed in the nozzle or in the chamber.

According to another feature of an embodiment of the present invention, there is provided an ink-jet printhead including a substrate on which a manifold for supplying ink is formed, a barrier layer, which is stacked on the substrate and on which an ink chamber to be filled with ink to be ejected and an ink channel for providing communication between the ink chamber and the manifold are formed, a nozzle plate, which is stacked on the barrier layer and in which a nozzle, through which an ink droplet is ejected, is formed, a volumetric structure, which is formed in a position where ink moves, the volumetric structure being sensitive to an external stimulus and being capable of varying in size to eject the ink droplet through the nozzle, and a stimulus generator, which applies a stimulus to the volumetric structure to vary a size of the volumetric structure.

In an embodiment of the present invention, the volumetric structure expands in size to eject the ink droplet through the nozzle, and the stimulus generator applies the stimulus to the volumetric structure to expand the size of the volumetric structure.

In this embodiment, the volumetric structure may be formed of stimulus sensitive hydrogel, and the stimulus sensitive hydrogel may be electrical field sensitive hydrogel.

The volumetric structure may be formed in the ink chamber. The volumetric structure may have a columnar shape, a hexahedral shape, or a cylindrical shape.

The stimulus generator may be a pair of electrodes respectively disposed above and below the volumetric structure. In this case, one of the pair of electrodes is a cathode and is disposed above the volumetric structure.

The stimulus generator may be a pair of electrodes respectively disposed at either side of the volumetric structure.

In another embodiment of the present invention, the volumetric structure contracts in size to eject the ink droplet through the nozzle, and the stimulus generator applies the stimulus to the volumetric structure to contract the size of the volumetric structure.

In this embodiment, the volumetric structure may be formed of stimulus sensitive hydrogel, and the stimulus sensitive hydrogel may be temperature sensitive hydrogel.

The stimulus generator may be a resistance heating material for applying heat to the volumetric structure.

The volumetric structure may be formed in the ink channel. In this case, the volumetric structure may have a columnar shape or a hexahedral shape.

The volumetric structure may be formed in the nozzle or in the ink chamber.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
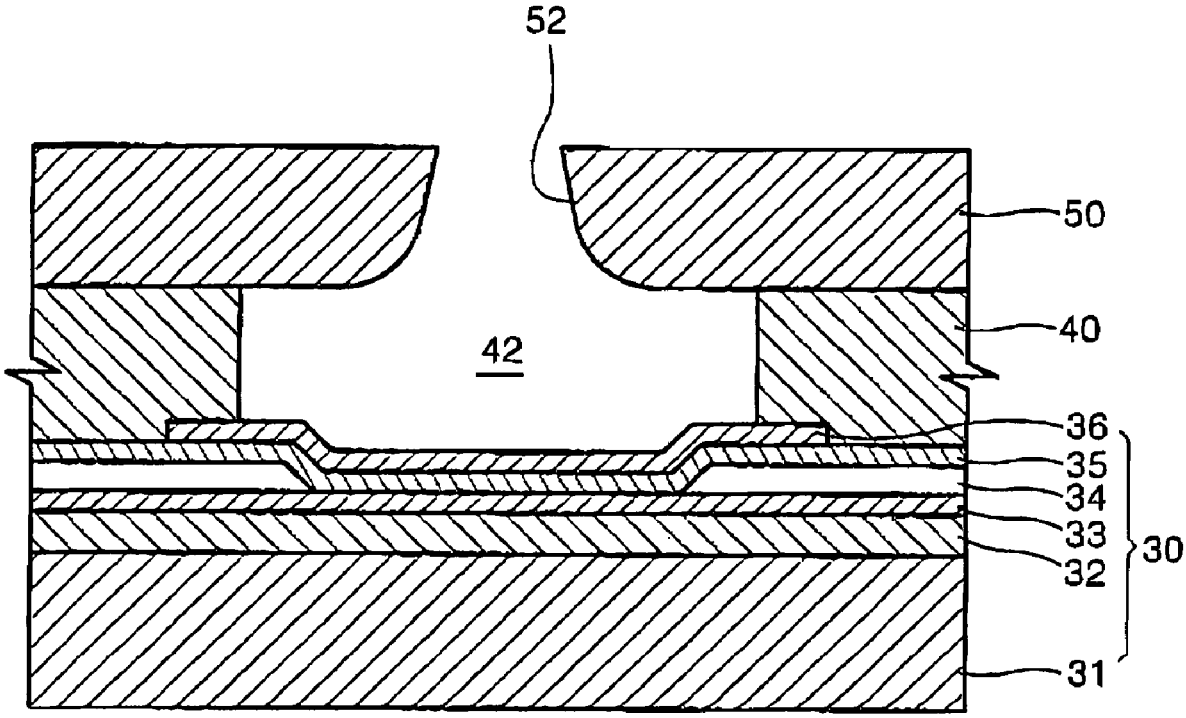
FIG. 1 (PRIOR ART)
FIG. 1 illustrates a cross-sectional view of a structure of a conventional thermally driven ink-jet printhead.
Figure 2:
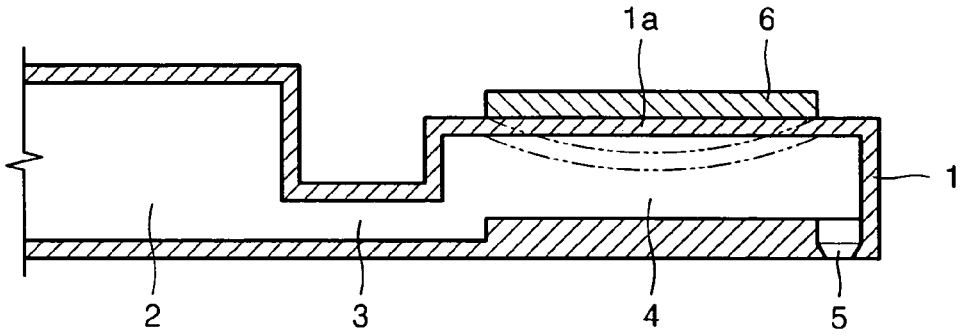
FIG. 2 (PRIOR ART)
FIG. 2 illustrates a general structure of a conventional piezoelectrically driven ink-jet printhead.
Figure 3:
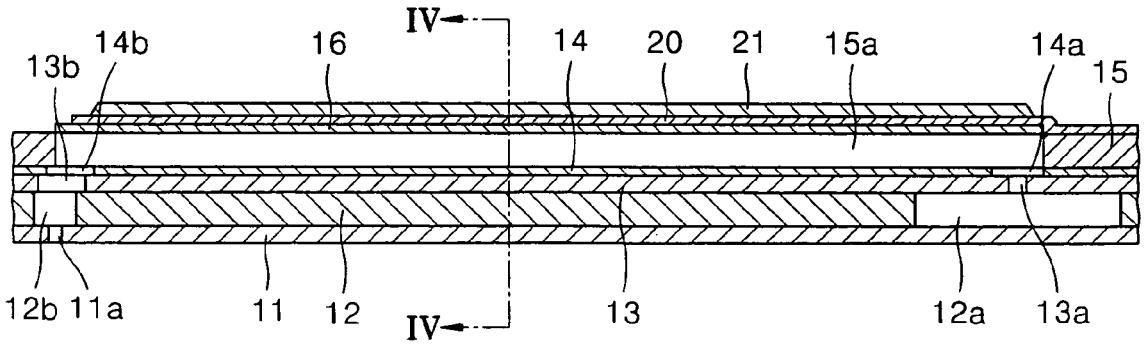
FIG. 3 (PRIOR ART)
FIG. 3 illustrates a cross-sectional view of a structure of a conventional piezoelectrically driven ink-jet printhead.
Figure 4:
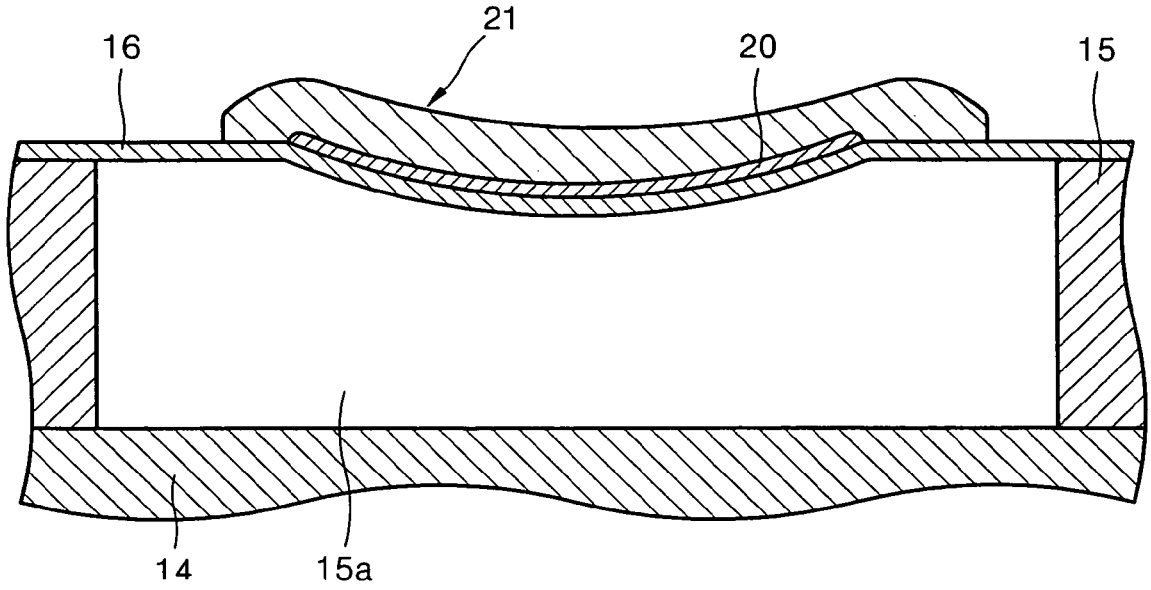
FIG. 4 (PRIOR ART)
FIG. 4 illustrates a cross-sectional view taken along line IV-IV of FIG. 3.
Figure 5A:
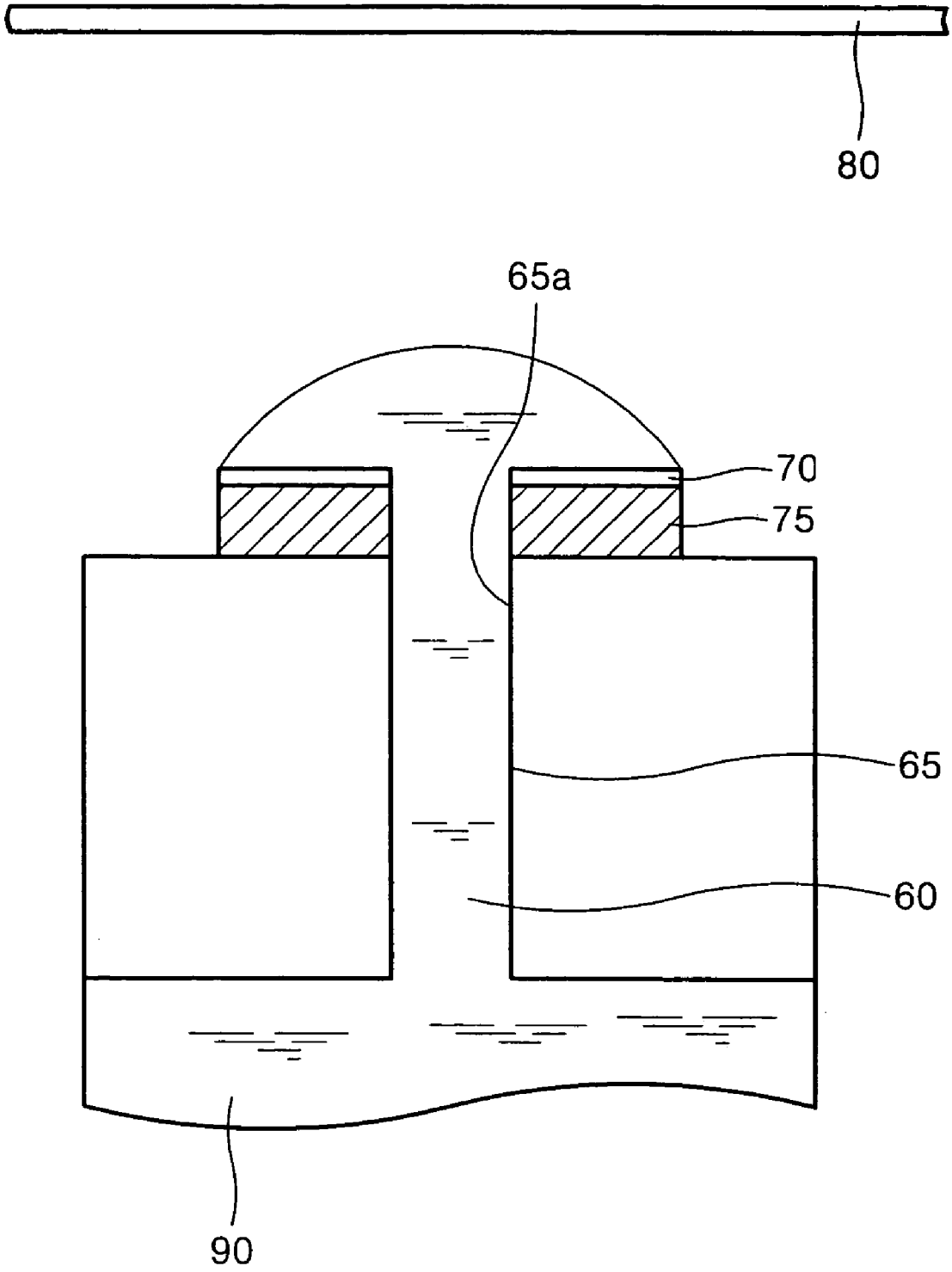
FIG. 5A (PRIOR ART)
FIGS. 5A and 5B illustrate cross-sectional views of a structure of another conventional ink-jet printhead.
Figure 5B:
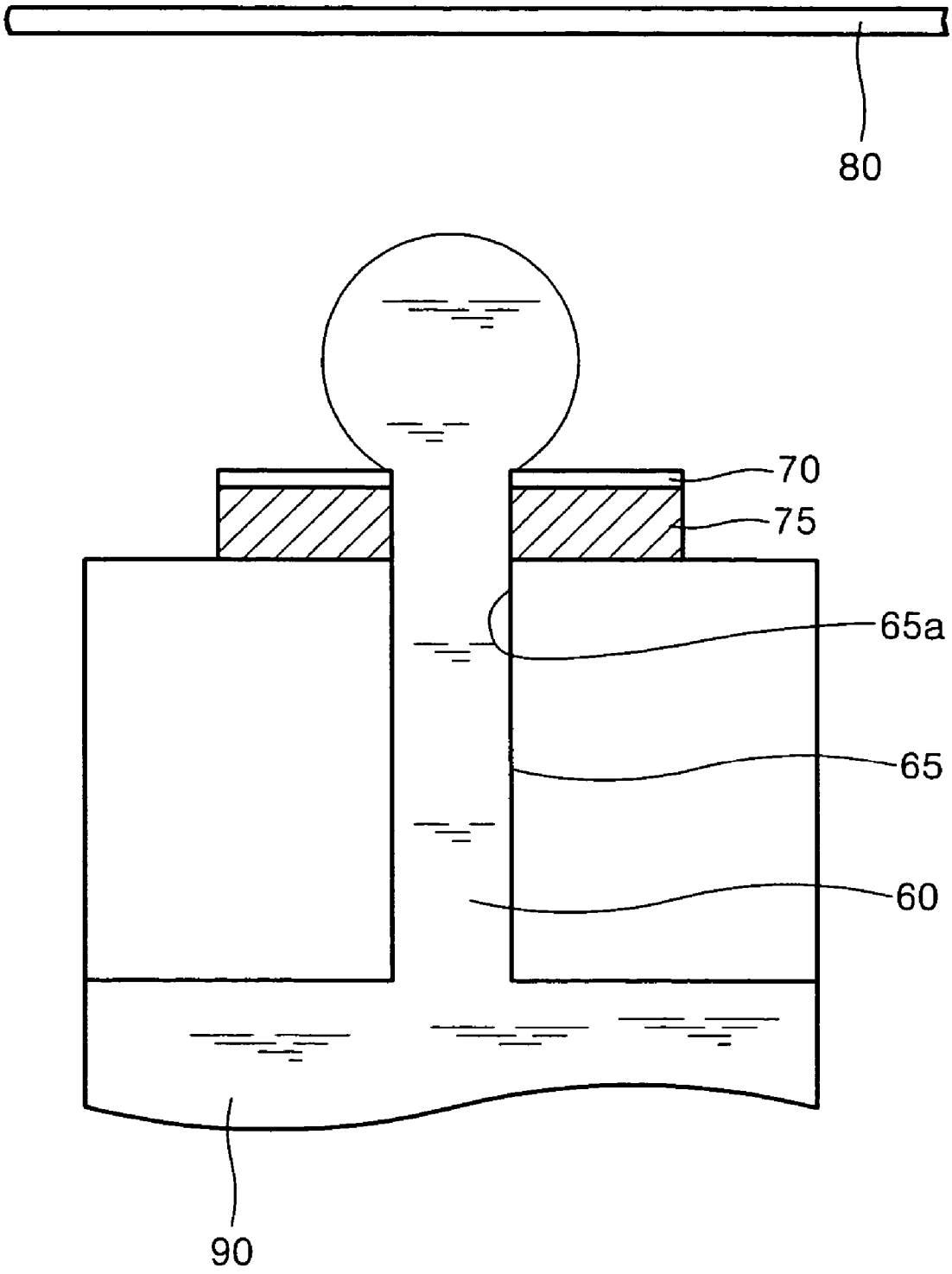
FIG. 5B (PRIOR ART)

Korean Patent Application No. 2003-4105, filed on Jan. 21, 2003, and entitled: "Droplet Ejector and Ink-Jet Printhead Using the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. It will also be understood that when a layer is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Like reference numerals refer to like elements throughout.

Figure 6:
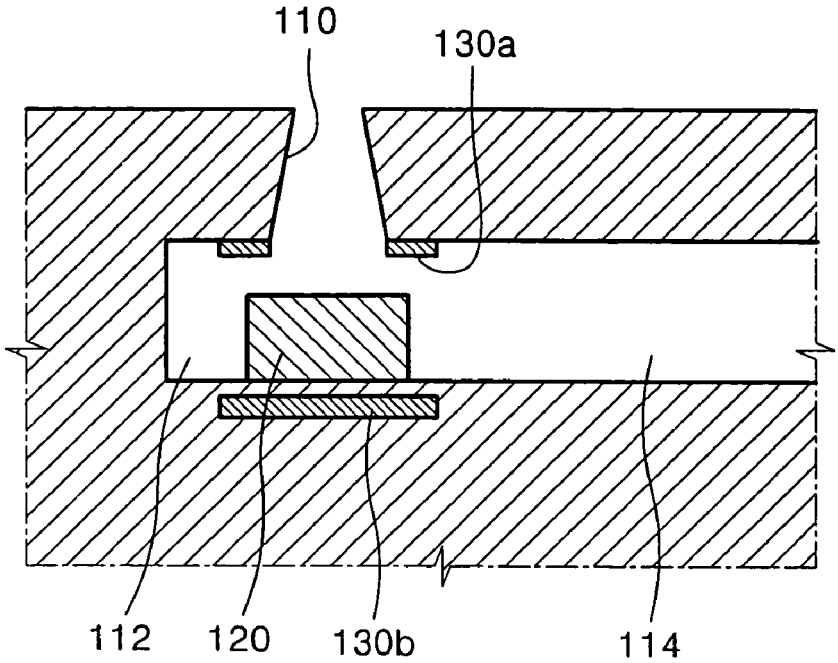
FIGS. 6 and 7 respectively illustrate a cross-sectional view and a plan view of a structure of a droplet ejector according to a first embodiment of the present invention.
Figure 7:
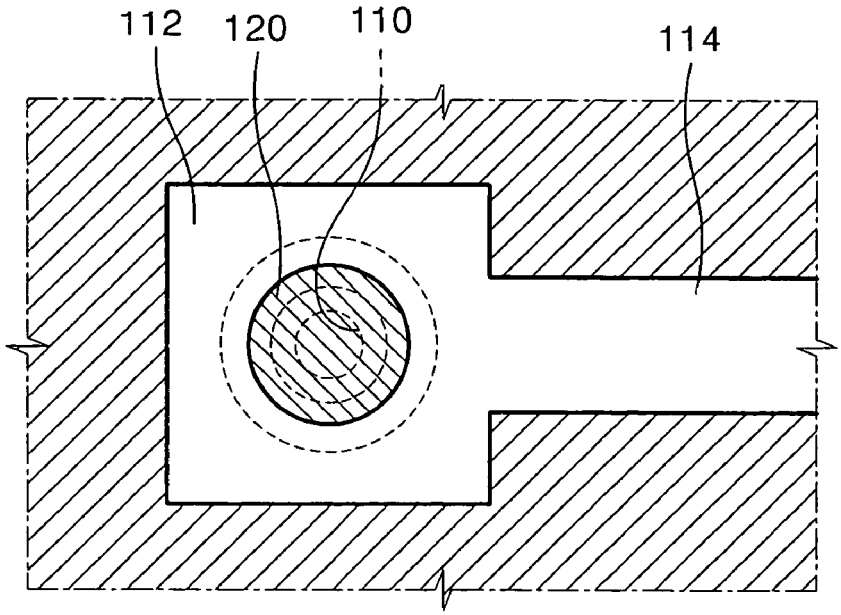

FIGS. 6 and 7 respectively illustrate a cross-sectional view and a plan view of a structure of a droplet ejector according to a first embodiment of the present invention.

Referring to FIGS. 6 and 7, a fluid flows to an inside of a fluid path formed by a nozzle 110, a chamber 112, and a channel 114. The nozzle 110, through which droplets are ejected, is formed on one end of the fluid path and has a tapered shape such that a diameter thereof decreases as the nozzle 110 extends toward an outlet. The chamber 112, filled with the fluid to be ejected, is formed under the nozzle 110, and the fluid is supplied to the chamber 112 through the channel 114.

A volumetric structure 120, formed of a material sensitive to an external stimulus, is formed in the chamber 112 filled with the fluid.

In the first embodiment, the volumetric structure 120 is formed of a material that expands when a stimulus is applied thereto and contracts to an original state when the stimulus is removed. Stimulus sensitive hydrogel is used as the material.

The stimulus sensitive hydrogel, which is a water containing polymer network, is a material sensitive to temperature, pH, electrical field, light, or molecular concentration, and has a large volume variation. The volume of the stimulus sensitive hydrogel may increase from several times to several hundreds of times according to a composition thereof and a size of the external stimulus.

The stimulus sensitive hydrogel is categorized into a variety of types depending on environmental factors to which hydrogel is sensitive, e.g., temperature sensitive hydrogel, pH-sensitive hydrogel, and electrical field sensitive hydrogel. Electrical field sensitive hydrogel is preferably used in the first embodiment.

The electrical field sensitive hydrogel has a non-isotropic characteristic so that a volume variation in response to a stimulus is first generated toward a cathode. In addition, the electrical field sensitive hydrogel has a response time of a volume variation faster than other similar material. The volume variation amount and volume variation speed can be precisely controlled according to a voltage size and a pulse width.

A volumetric structure formed of stimulus sensitive hydrogel as described above may be formed through photopatterning and photopolymerization. Specifically, a liquid pre-hydrogel mixture is filled in a fluid path, and light, for example, ultraviolet rays, is irradiated onto the liquid pre-hydrogel mixture through a photomask. Next, unpolymerized mixture liquid is removed such that the volumetric structure 120 having a desired shape and size is formed in the chamber 112.

For example, when the volumetric structure 120 is formed of electrical field sensitive hydrogel, the volumetric structure 120 may be formed by radiating light having a strength of about 30 $mW/cm^2$ on a hydrogel pre-polymer mixture composed of acrylic acid and 2-hydroxyethyl methacrylate in a 1:4 molar ratio, ethylene glycol dimethacrylate 1.0 wt %, and 2,2-dimethoxy-2-phenyl-acetophenone 3.0 wt % through the photomask and cleaning the hydrogel pre-polymer mixture with methanol.

Although the volumetric structure 120 as illustrated in FIG. 6 has a columnar shape, the volumetric structure 120 may have a hexahedral shape or a cylindrical shape in which a through hole is formed.

A pair of first and second electrodes 130*a* and 130*b* are disposed above and below the volumetric structure 120. The first and second electrodes 130*a* and 130*b* serve as a stimulus generator that applies a stimulus to the volumetric structure 120. In the first embodiment, the first and second electrodes 130*a* and 130*b* apply an electrical field to the volumetric structure 120. As described above, since the volumetric structure 120 formed of electrical field sensitive hydrogel has a non-isotropic characteristic, preferably, the first electrode 130*a* is a cathode. In addition, although not shown, a conductor for applying a voltage is connected to the first and second electrodes 130*a* and 130*b*.

Although the first and second electrodes 130*a* and 130*b* are respectively disposed above and below the volumetric structure 120, the first and second electrodes 130*a* and 130*b* may be disposed at either side of the volumetric structure 120.

FIGS. 8A through 8D illustrate an operation of ejecting droplets using a droplet ejector when the volumetric structure 120 is formed of electrical field sensitive hydrogel.

Figure 8A:
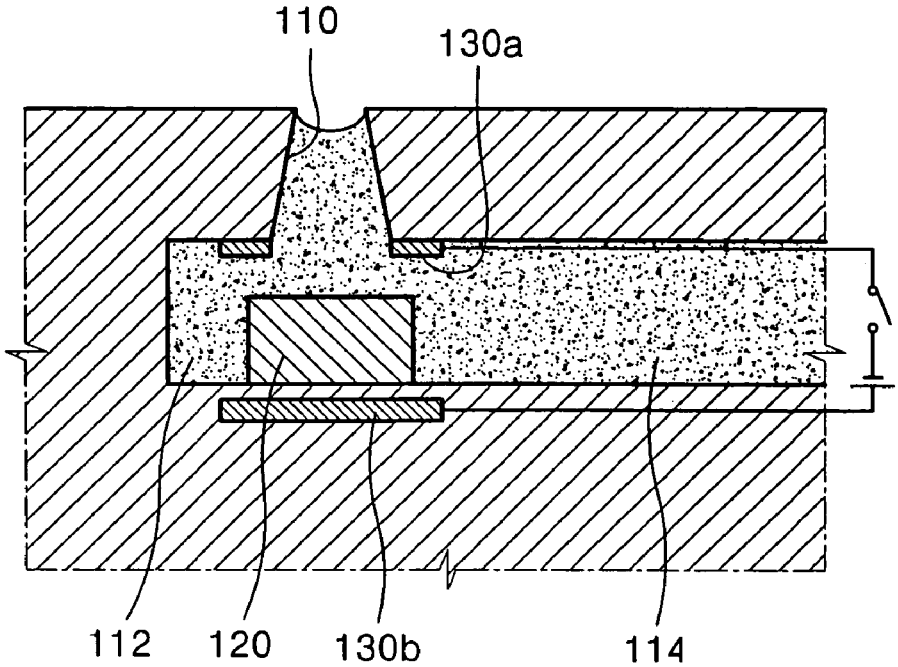
FIGS. 8A through 8D illustrate an operation of ejecting droplets using a droplet ejector according to the first embodiment of the present invention.

First, as shown in FIG. 8A, when no voltage is applied to the two electrodes 130*a* and 130*b*, the volumetric structure 120 is initially maintained in a contracted state.

Figure 8B:
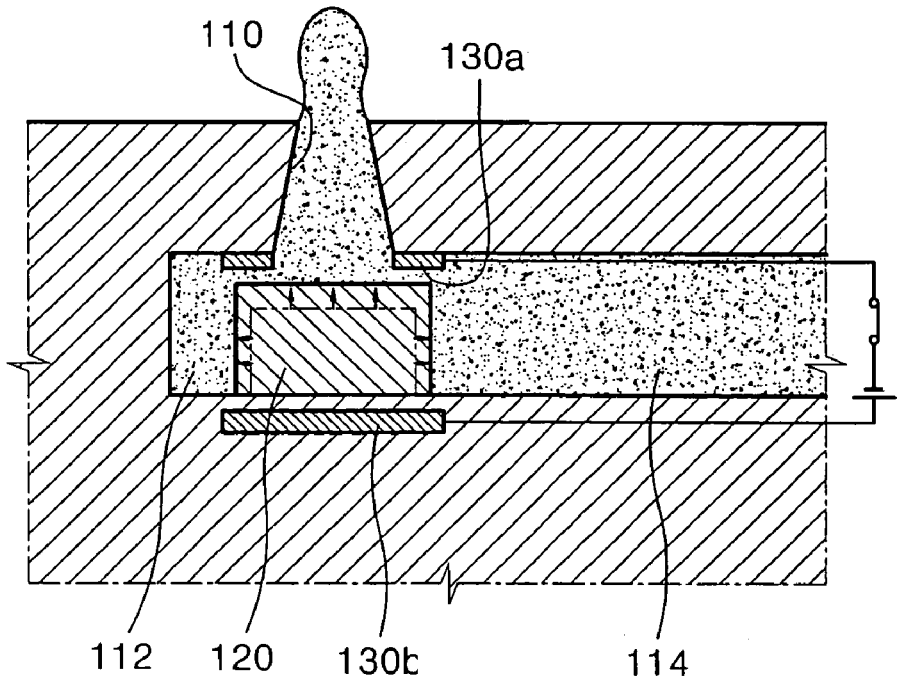

Subsequently, as shown in FIG. 8B, when a voltage is applied to the two electrodes 130*a* and 130*b*, an electrical field is generated between the two electrodes 130*a* and 130*b*. Due to the electrical field, the volumetric structure 120 expands. When the volumetric structure expands, a fluid in the chamber 112 is ejected through the nozzle 110.

Figure 8C:
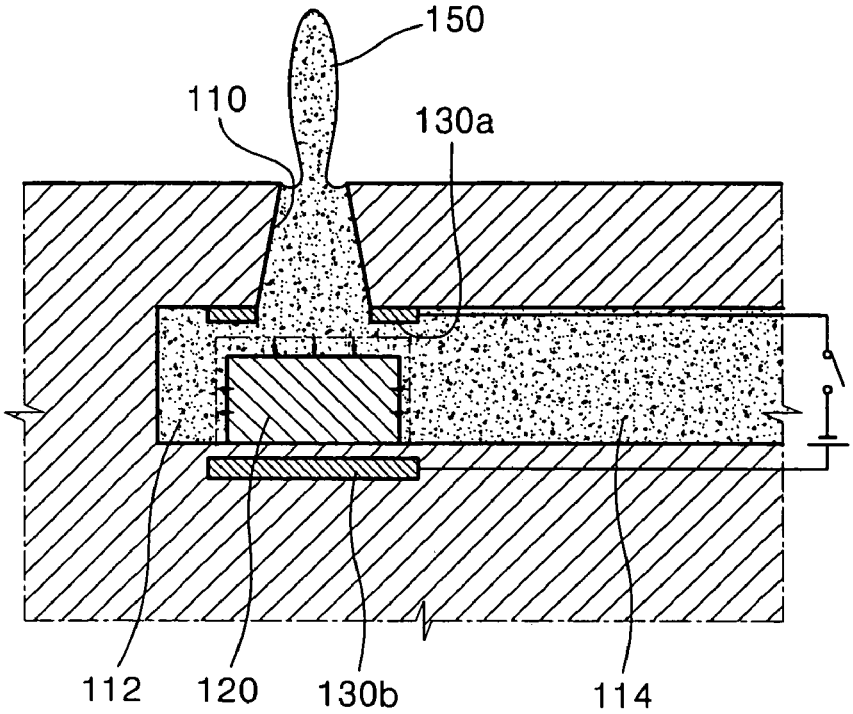

Next, as shown in FIG. 8C, when the voltage applied to the two electrodes 130*a* and 130*b* is removed, the volumetric structure 120 contracts to an original state. Accordingly, the fluid to be ejected through the nozzle 110 is separated from the fluid in the nozzle 110 and is ejected as a droplet 150 by a contraction force.

Figure 8D:
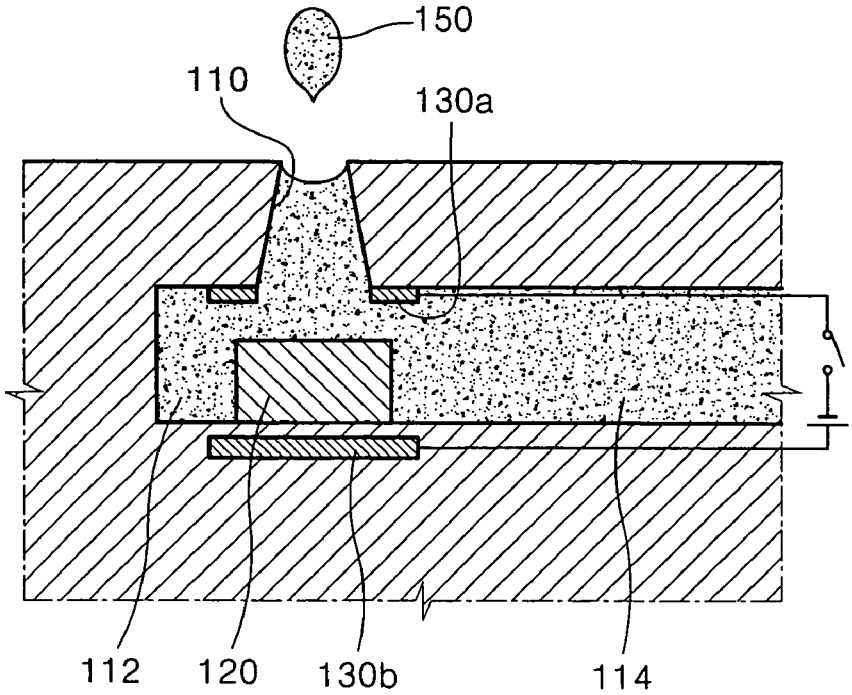

Last, as shown in FIG. 8D, when the chamber 112 is refilled with fluid through the channel 114 due to a surface tension of the nozzle 110, a meniscus moves to an outlet of the nozzle 110, and the volumetric structure is restored to the original state.

Hereinafter, an ink-jet printhead using the above-described droplet ejector will be described.

Figure 9:
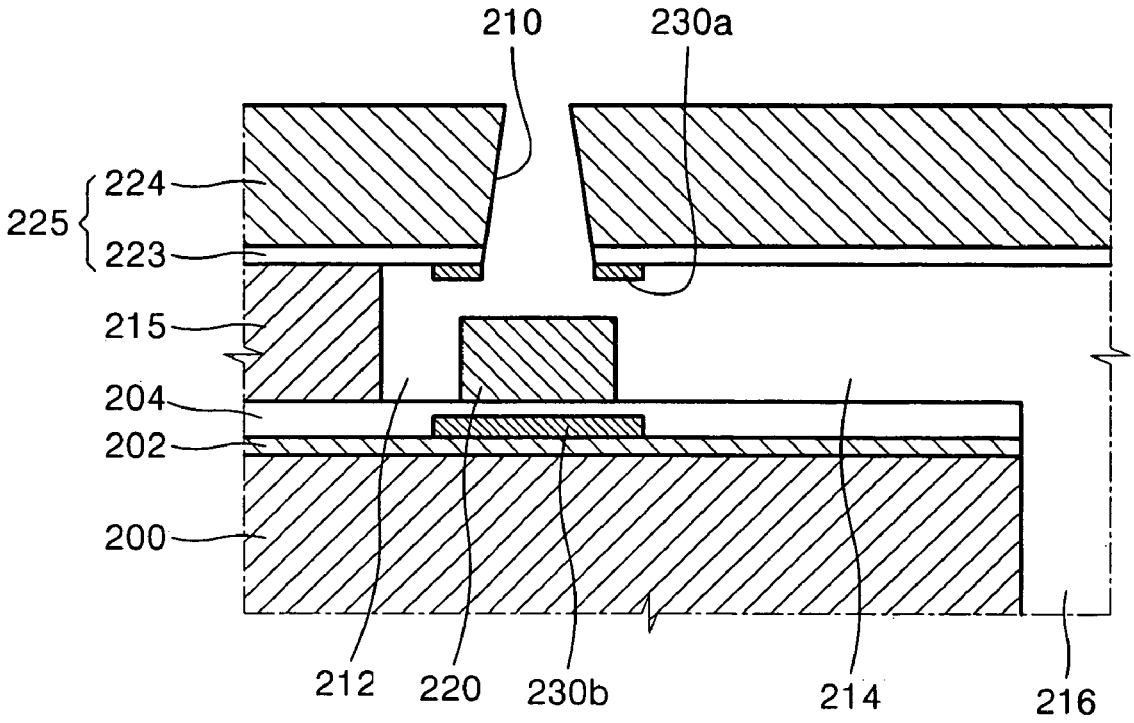
FIGS. 9 and 10 respectively illustrate a cross-sectional view and a plan view of a structure of an ink-jet printhead using a droplet ejector according to a second embodiment of the present invention.
Figure 10:
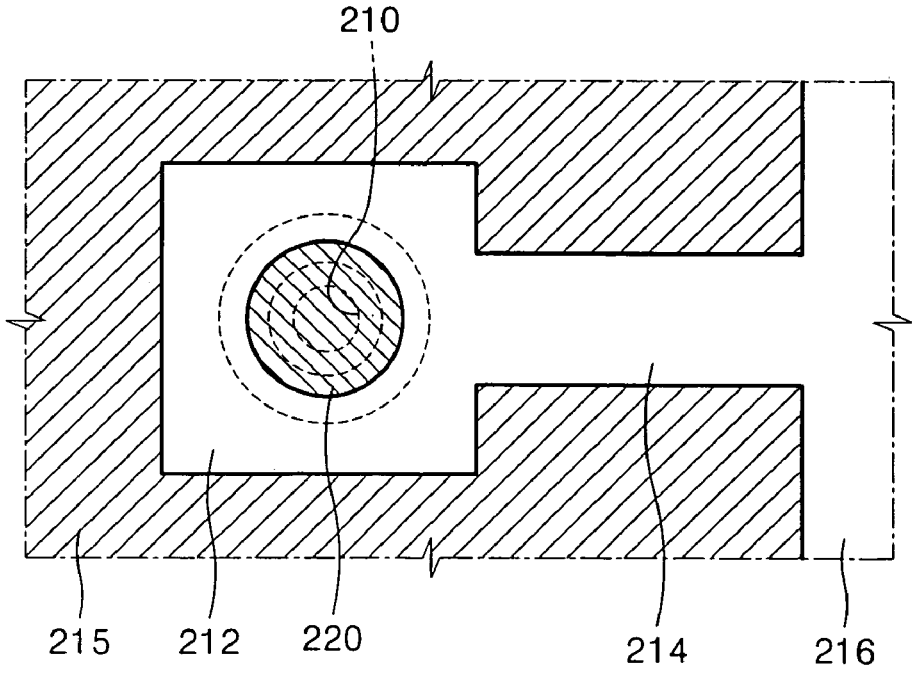

FIGS. 9 and 10 respectively illustrate a cross-sectional view and a plan view of a structure of an ink-jet printhead according to a second embodiment of the present invention.

Referring to FIGS. 9 and 10, the ink-jet printhead includes a substrate 200, a barrier layer 215, a nozzle plate 225, a volumetric structure 220, and first and second electrodes 230*a* and 230*b*.

A silicon wafer that is widely used to manufacture integrated circuits (ICs) may be used as the substrate 200. A manifold 216 for supplying ink is formed on the substrate 200, and the manifold 216 is in communication with an ink reservoir (not shown) in which ink is stored.

The barrier layer 215 is formed on the substrate 200, and an ink chamber 212 to be filled with ink to be ejected and an ink channel 214 for providing communication between the ink chamber 212 and the manifold 216 are formed on the barrier layer 215. Here, the ink channel 214 is a path through which ink is supplied from the manifold 216 to the ink chamber 212.

Meanwhile, although only an exemplary unit structure of the ink-jet printhead is shown, in an ink-jet printhead manufactured in a chip state, a plurality of ink chambers may be disposed in one row or two rows, or may be disposed in three or more rows to improve printing resolution.

The volumetric structure 220 that expands when a stimulus is applied thereto is formed in the ink chamber 212. In the second embodiment, the volumetric structure 220 is formed of electrical field sensitive hydrogel, which is a material that expands if an electrical field is applied to the volumetric structure 220.

Although the volumetric structure 220 has a columnar shape, the volumetric structure 220 may have a hexahedral shape or a cylindrical shape in which a through hole is formed.

The second electrode 230*b* of the first and second electrodes 230*a* and 230*b* for applying an electrical field to the volumetric structure 220 is formed between the substrate 200 and the barrier layer 215. Here, the second electrode 230*b* is disposed below the volumetric structure 220.

In addition, a first insulating layer 202 is formed between the second electrode 230*b* and the substrate 200. A second insulating layer 204 for passivation and insulation of the second electrode 230*b* is formed between the volumetric structure 220 and the second electrode 230*b*.

A nozzle plate 225 formed of a third insulating layer 223 and a metallic plate 224 is stacked on the barrier layer 215. A nozzle 210 is formed in a position of the nozzle plate 225, which corresponds to a center of the ink chamber 212. The nozzle 210 has a tapered shape such that a diameter thereof decreases as the nozzle 210 extends toward an outlet.

The first electrode 230*a* is formed on a bottom surface of the nozzle plate 225 to surround the nozzle 210. The first electrode 230*a* applies an electrical field to the volumetric structure 220 together with the second electrode 230*b*. In this case, preferably, the first electrode 230*a* is a cathode. In addition, although not shown, a conductor for applying a voltage is connected to the first and second electrodes 230*a* and 230*b*.

In the above structure, when the voltage is applied to the first and second electrodes 230*a* and 230*b*, an electrical field is generated between the first and second electrodes 230*a* and 230*b*. Due to the electrical field, the volumetric structure 220 formed in the ink chamber 212 expands from an original state. When the volumetric structure 220 expands, ink is ejected through the nozzle 210. Subsequently, when the voltage applied to the first and second electrodes 230*a* and 230*b* is removed, the expanded volumetric structure 220 contracts to the original state, and ink is ejected through the nozzle 210 in droplet form by a contraction force. Next, when ink is refilled in the ink chamber 212 from the manifold 216 through the ink channel 214, due to a surface tension of the nozzle 210, a meniscus moves to an outlet of the nozzle 210, and the volumetric structure 220 is restored to the original state.

Hereinafter, a method for manufacturing the above-described ink-jet printhead will be described.

First, the first insulating layer 202, the second electrode 230*b*, and the second insulating layer 204 are formed on the substrate 200.

Next, the manifold to be in communication with an ink reservoir (not shown) is formed on the substrate 200.

Subsequently, the barrier layer 215 is stacked above the substrate 200, and then, the ink chamber 212 and the ink channel 214 are formed on the barrier layer 215. The ink channel 214 provides communication between the manifold 216 and the ink chamber 212.

Next, the volumetric structure 220 is formed in the ink chamber 212. Specifically, a liquid pre-hydrogel mixture is filled in the ink chamber 212, the ink channel 214, and the manifold 216, and light, for example, ultraviolet rays, is irradiated onto the liquid pre-hydrogel mixture through a photomask. Next, unpolymerized mixture liquid is removed such that the volumetric structure 220 having a desired shape and size is formed in the chamber 212.

Last, the nozzle plate 225 formed of the third insulating layer 223 and the metallic plate 224 is stacked on the barrier layer 215, and then, the nozzle 210 and the first electrode 230*a* for surrounding the nozzle 210 are formed. The nozzle 210 is in communication with the ink chamber 212.

As described above, the ink-jet printhead has a structure in which an electrode is disposed above and an electrode is disposed below a volumetric structure. Alternately, the electrodes may be disposed in other positions with respect to the volumetric structure. An example thereof is shown in FIGS. 11 and 12.

Figure 11:
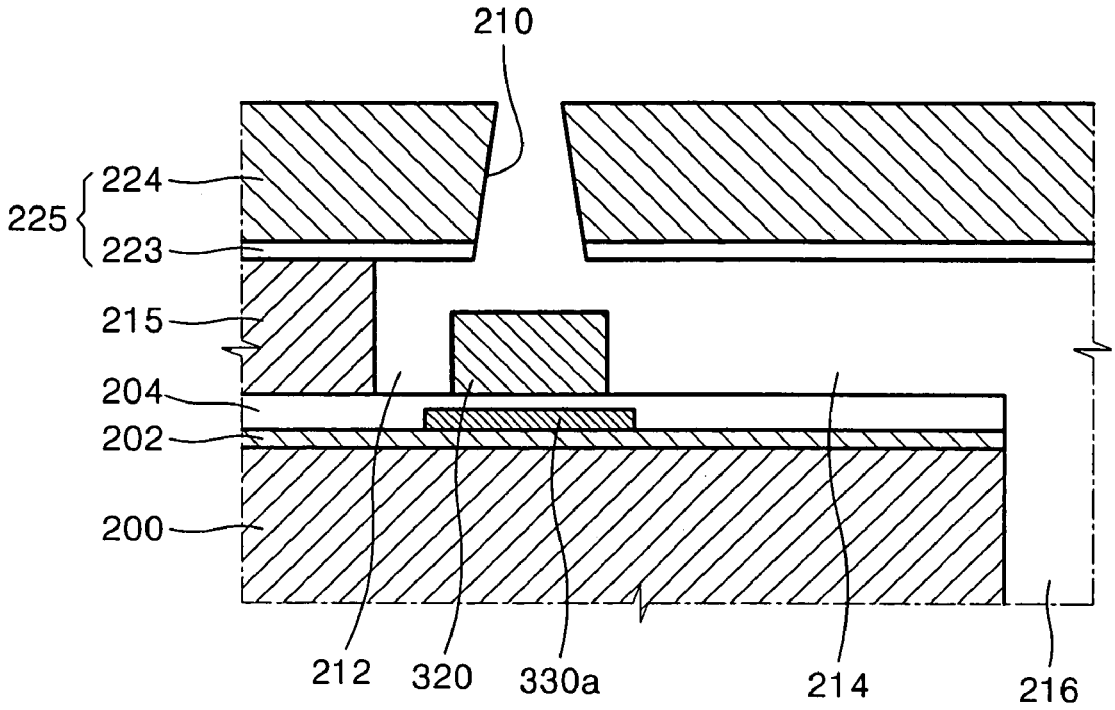
FIGS. 11 and 12 respectively illustrate a cross-sectional view and a plan view of a structure of an ink-jet printhead using a droplet ejector according to a third embodiment of the present invention.
Figure 12:
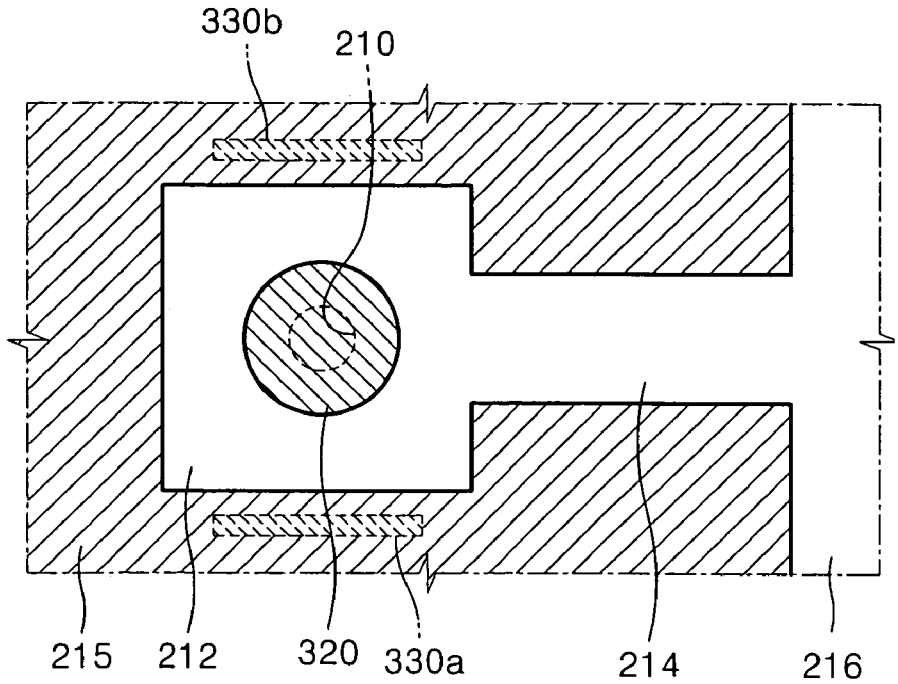

Referring to FIGS. 11 and 12, in a third embodiment of the present invention, a volumetric structure 320 is formed in the ink chamber 212, and first and second electrodes 330*a* and 330*b* for applying an electrical field to the volumetric structure 320 are respectively disposed below either side of the volumetric structure 320.

Figure 13:
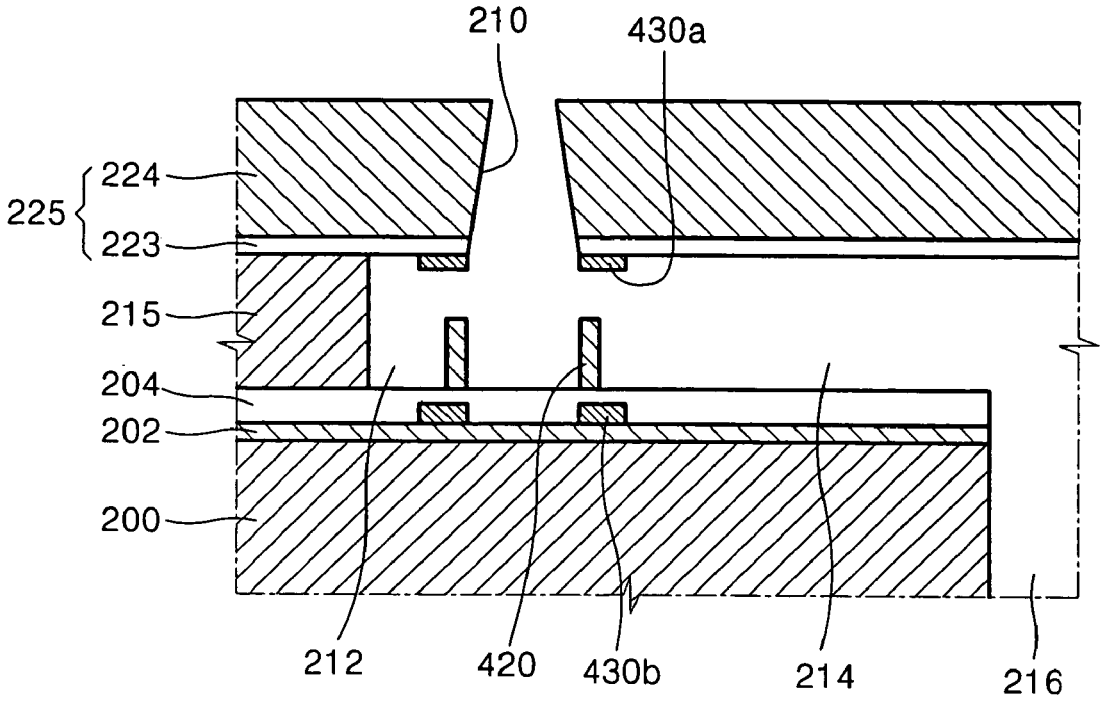
FIGS. 13 and 14 respectively illustrate a cross-sectional view and a plan view of a structure of an ink-jet printhead using a droplet ejector according to a fourth embodiment of the present invention.
Figure 14:
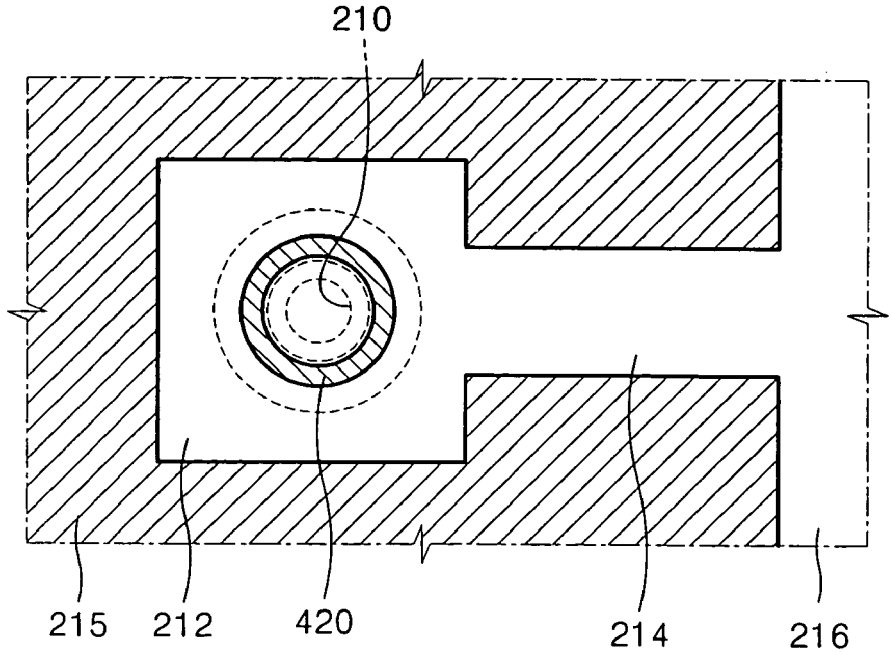

In addition to varying a position of the first and second electrodes, in a fourth embodiment of the present invention, the volumetric structure 320 formed in the ink chamber 212 may have a variety of shapes. An example thereof is shown in FIGS. 13 and 14. Referring to FIGS. 13 and 14, a volumetric structure 420 having a cylindrical shape, in which a through hole is formed, is formed in the ink chamber 212. First and second electrodes 430*a* and 430*b* for applying an electrical field to the volumetric structure 420 are respectively disposed above and below the volumetric structure 420.

Hereinafter, a droplet ejector according to a fifth embodiment of the present invention will be described.

Figure 15:
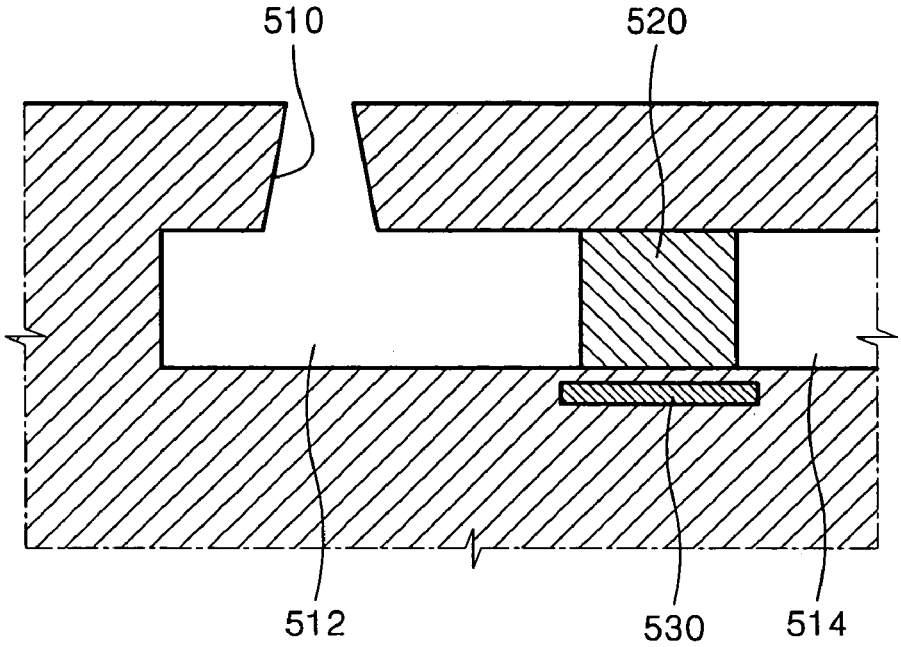
FIGS. 15 and 16 respectively illustrate a cross-sectional view and a plan view of a structure of a droplet ejector according to a fifth embodiment of the present invention when no stimulus is applied to a volumetric structure.
Figure 16:
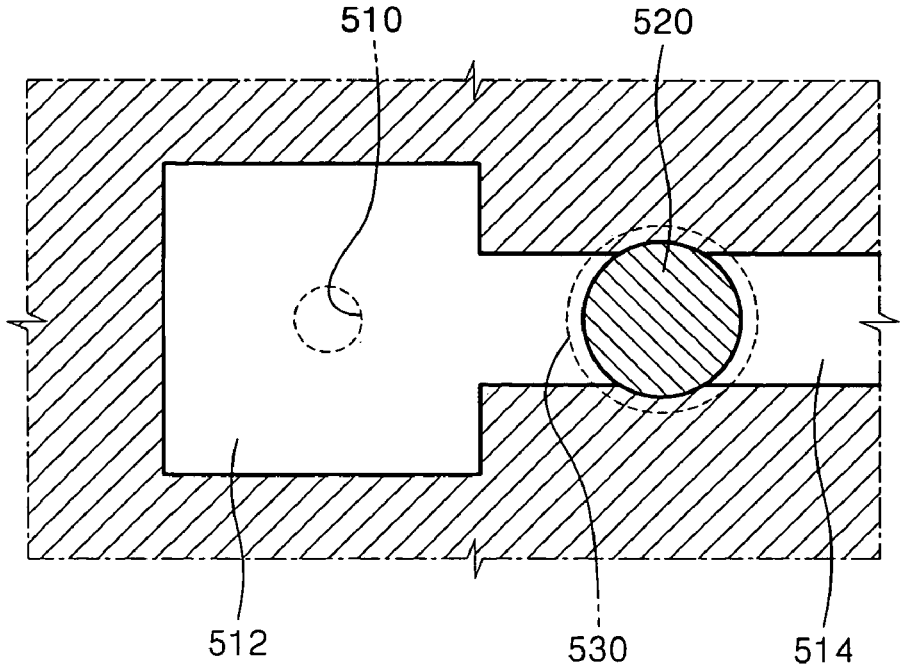
Figure 17:
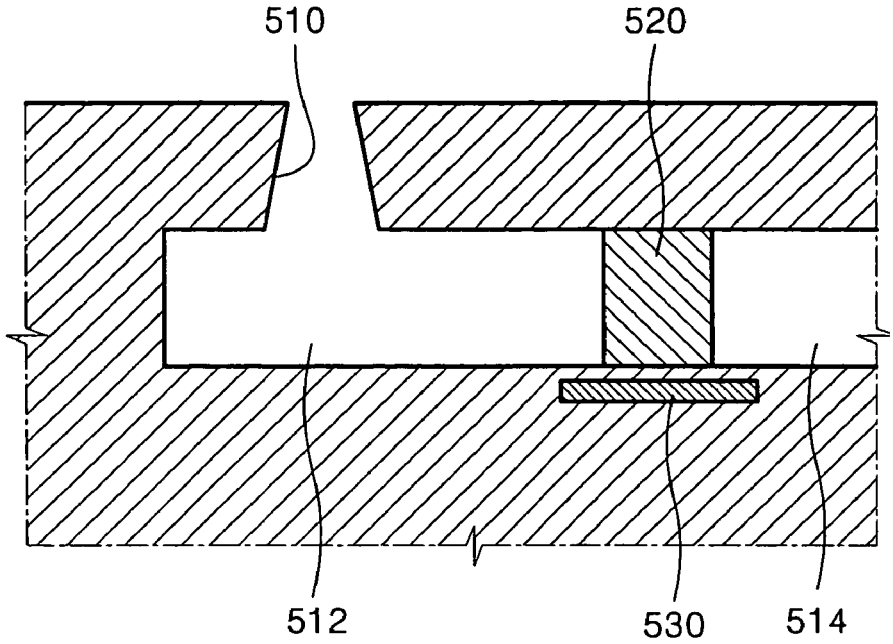
FIGS. 17 and 18 respectively illustrate a cross-sectional view and a plan view of a structure of a droplet ejector according to the fifth embodiment of the present invention when a stimulus is applied to a volumetric structure and the volumetric structure contracts.
Figure 18:
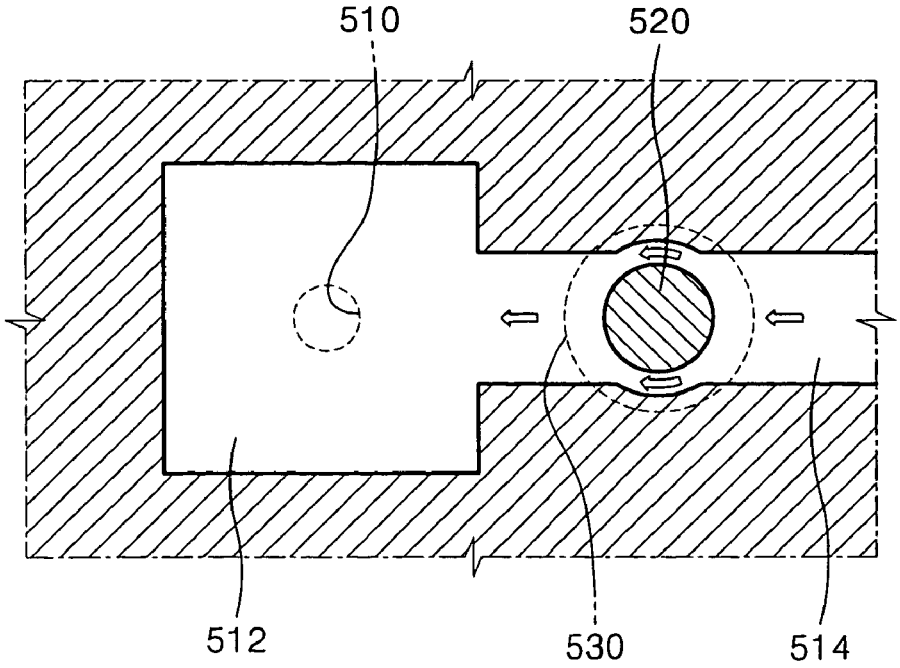

FIGS. 15 through 18 illustrate a droplet ejector according to the fifth embodiment of the present invention. FIGS. 15 and 16 respectively illustrate a cross-sectional view and a plan view of a structure of a droplet ejector when no stimulus is applied to a volumetric structure. FIGS. 17 and 18 respectively illustrate a cross-sectional view and a plan view of a structure of a droplet ejector when a stimulus is applied to a volumetric structure and the volumetric structure contracts.

Referring to FIGS. 15 through 18, a fluid flows to an inside of a fluid path formed of a nozzle 510, a chamber 512, and a channel 514. The nozzle 510 through which droplets are ejected is formed on one end of the fluid path and has a tapered shape such that a diameter thereof decreases as the nozzle 510 extends toward an outlet. The chamber 512, filled with the fluid to be ejected, is formed under the nozzle 510, and the fluid is supplied to the chamber 512 through the channel 514.

A volumetric structure 520 that opens and closes the channel 514 due to a variation in a volume thereof is formed in the channel 514. The volumetric structure 520 is a valve that controls the flow of the fluid flowing to the channel 514 and is formed of a material sensitive to an external stimulus.

In the fifth embodiment, the volumetric structure 520 is formed of a material that contracts when a stimulus is applied thereto and expands to an original state when the stimulus is removed therefrom. Stimulus sensitive hydrogel is preferably used as the material.

The stimulus sensitive hydrogel is a water containing polymer network and is categorized into a variety of types depending on environmental factors to which hydrogel is sensitive. Temperature sensitive hydrogel is preferably used in the fifth embodiment.

Figure 19:
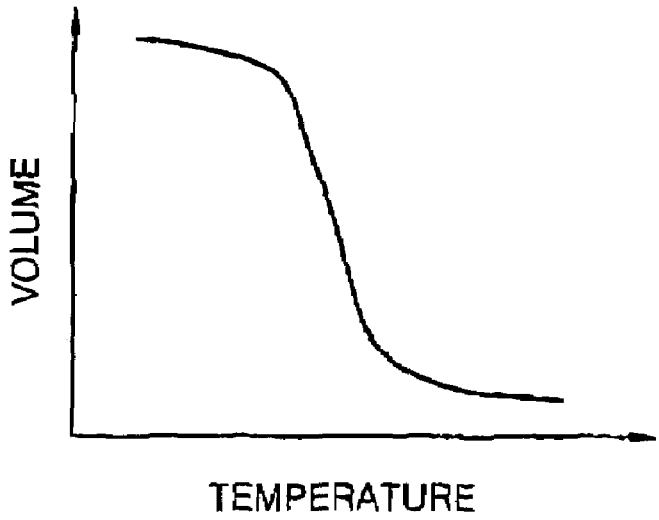
FIG. 19 is a graph of temperature versus volume of temperature sensitive hydrogen.

When the temperature of the temperature sensitive hydrogel is higher than a lower critical solution temperature (LCST) of a polymer, the volume of the temperature sensitive hydrogel is reduced. When the temperature of temperature sensitive hydrogel is lower than the LCST of the polymer, the volume of the temperature sensitive hydrogel is increased. Specifically, if the temperature of temperature sensitive hydrogel is lower than the LCST of the polymer, a hydrogen bond between the polymer in the temperature sensitive hydrogel and a water molecule is formed, the water molecule is absorbed in the temperature sensitive hydrogel, and the temperature sensitive hydrogel expands. If the temperature of the temperature sensitive hydrogel is higher than the LCST of the polymer, thermal agitation is increased, the hydrogen bond disappears, the water molecule is released out of the temperature sensitive hydrogel, and the temperature sensitive hydrogel contracts. The temperature sensitive hydrogel has a volume variation from several times to several hundreds of times within a temperature range of about 15-30° C. A typical volume variation is shown in a graph of volume versus temperature in FIG. 19.

A structure formed of stimulus sensitive hydrogel may be formed through photopatterning and photopolymerization. Specifically, a liquid pre-hydrogel mixture is filled in a fluid path, and light, for example, ultraviolet rays, is irradiated onto the liquid pre-hydrogel mixture through a photomask. Next, unpolymerized mixture liquid is removed such that the volumetric structure 520 having a desired shape and size is formed in the channel 514.

For example, when the volumetric structure 520 is formed of temperature sensitive hydrogel, the volumetric structure 520 may be formed using a precursor solution through photopolymerization. Specifically, the volumetric structure 520 may be formed by exposing light having a strength of about 15 $mW/cm^2$ on a precursor solution composed of 1.09 g N-isopropylacryl-amide, 62 mg N.N'-methylenebisacrylamide, 77 mg 2,2-dimethoxy-2-phenylaceto-phenone, 1.5 mL dimethylsulphoxide, and 0.5 mL deionized water through the photomask and cleaning the precursor solution with methanol.

Although the volumetric structure 520 is illustrated as having a columnar shape, the volumetric structure 520 may have a hexahedral shape. In addition, in the alternative to being formed in the channel 514, the volumetric structure 520 may be formed in the nozzle 510 or in the chamber 512.

A resistance heating material 530 is disposed below the volumetric structure 520. The resistance heating material 530 serves as a stimulus generator which applies a stimulus to the volumetric structure 520. In the present embodiment, the resistance heating material 530 applies heat to the volumetric structure 520. Meanwhile, although not shown, a conductor for applying a voltage is connected to the resistance heating material 530.

Although the resistance heating material 530 is disposed below the volumetric structure 520, the resistance heating material 530 may be disposed at another location near the volumetric structure 520, and a plurality of resistance heating materials may be included.

In the above structure, when the resistance heating material 530 is not heated, as shown in FIGS. 15 and 16, the volumetric structure 520 is initially maintained in an expanded state. As such, the channel 514 is closed. However, when the resistance heating material 530 is heated, as shown in FIGS. 17 and 18, the volumetric structure 520 contracts, thereby opening the channel 514.

FIGS. 20A through 20D illustrate an operation of ejecting droplets using a droplet ejector when the volumetric structure 520 is formed of temperature sensitive hydrogel.

Figure 20A:
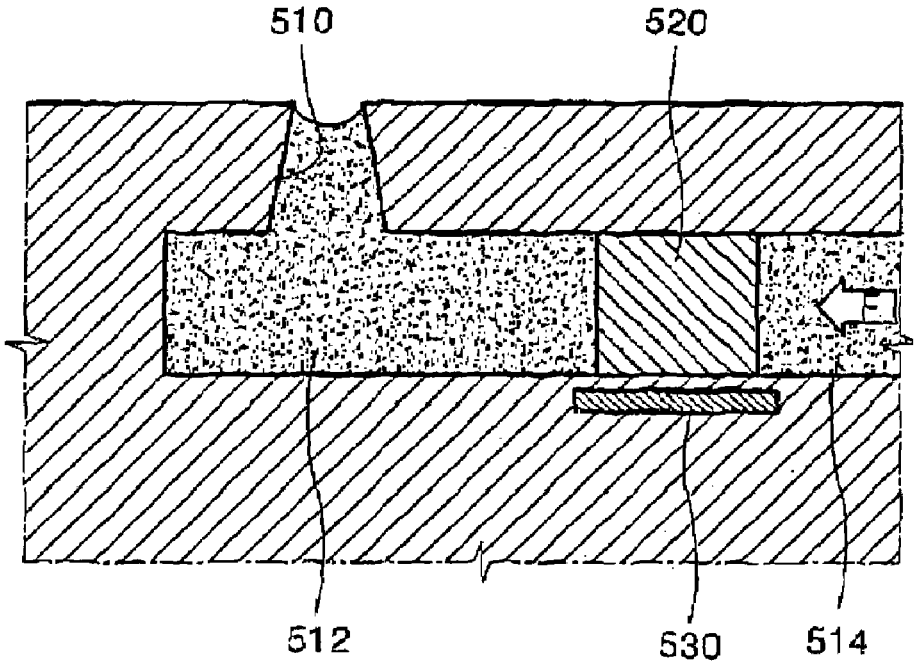
FIGS. 20A through 20D illustrate an operation of ejecting droplets using a droplet ejector according to the fifth embodiment of the present invention.

First, as shown in FIG. 20A, when the resistance heating material 530 is not heated, the volumetric structure 520 is initially maintained in an expanded state. Thus, the channel 514 is closed, and the flow of a fluid (indicated by an arrow F) does not occur.

Figure 20B:
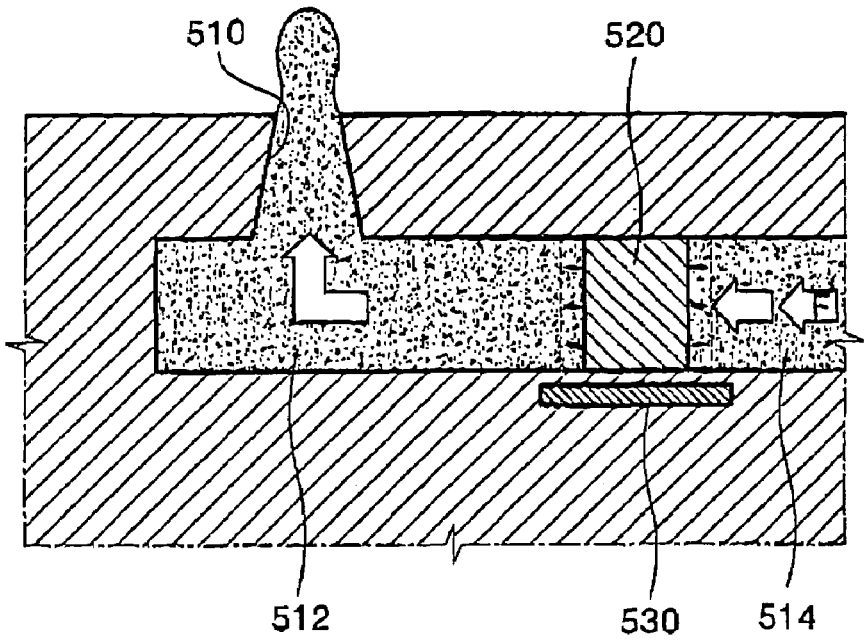

Next, as shown in FIG. 20B, when a voltage is applied to the resistance heating material 530 and heat is generated by the resistance heating material 530, the temperature of the volumetric structure 520 increases. As such, the volumetric structure 520 contracts, and the channel 514 is opened. Due to a pressure applied from a fluid reservoir (not shown) in communication with the channel 514, when the channel 514 is open, the flow of the fluid occurs, and the fluid in the chamber 512 is ejected through the nozzle 510.

Figure 20C:
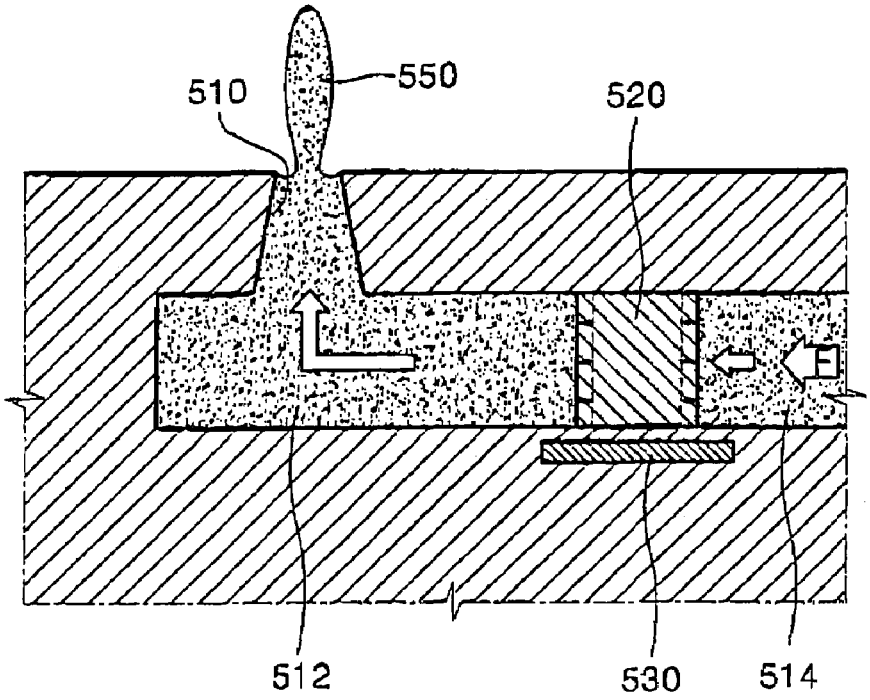

Subsequently, as shown in FIG. 20C, when the voltage applied to the resistance heating material 530 is removed, the volumetric structure 520 cools and expands to the original state. As the volumetric structure 520 expands, the channel 514 is closed again. Thus, the fluid ejected through the nozzle 510 is separated from the fluid in the nozzle 510 and is ejected in a form of a droplet 550.

Figure 20D:
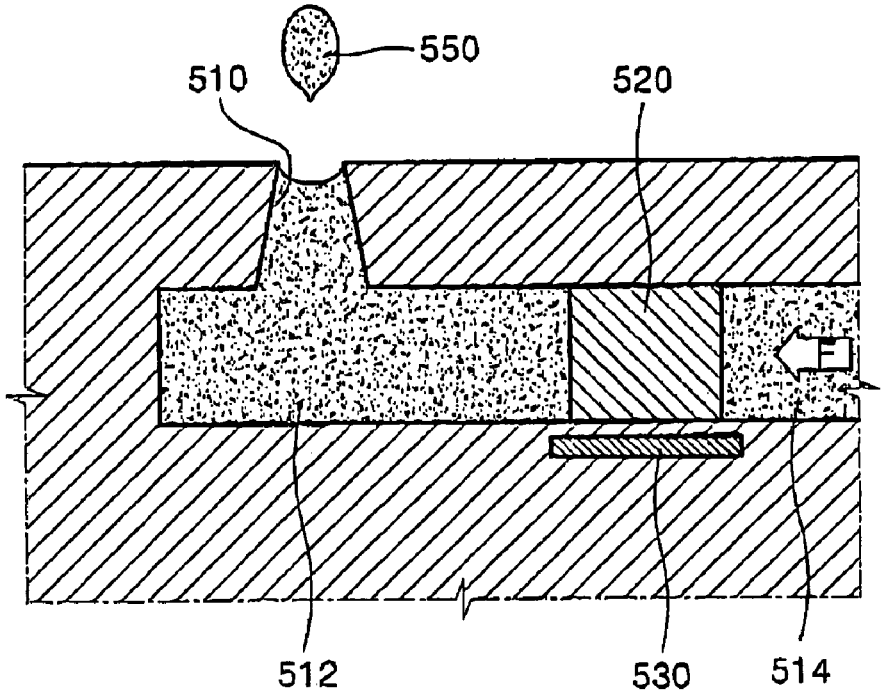

Last, as shown in FIG. 20D, the channel 514 is completely closed, the droplet 550 is separated from the nozzle 510, the movement of a meniscus is stabilized, and the volumetric structure 520 is restored to the original state.

Hereinafter, an ink-jet printhead using the above-described droplet ejector will be described.

Figure 21:
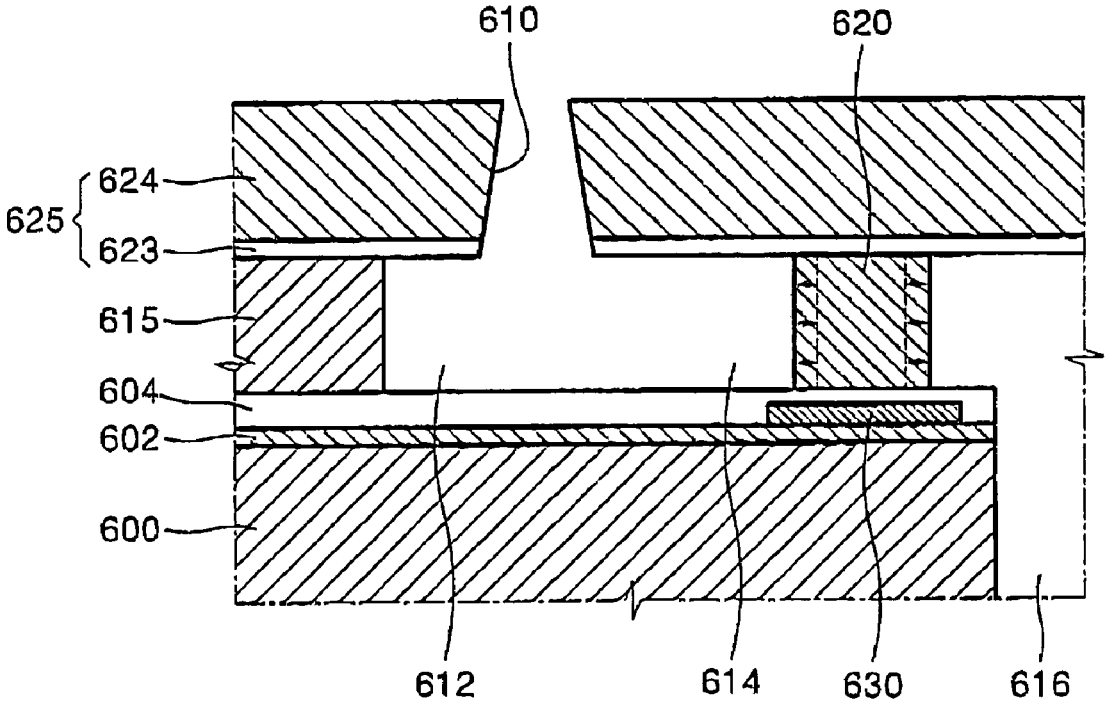
FIGS. 21 and 22 respectively illustrate a cross-sectional view and a plan view of a structure of an ink-jet printhead using a droplet ejector according to a sixth embodiment of the present invention.
Figure 22:
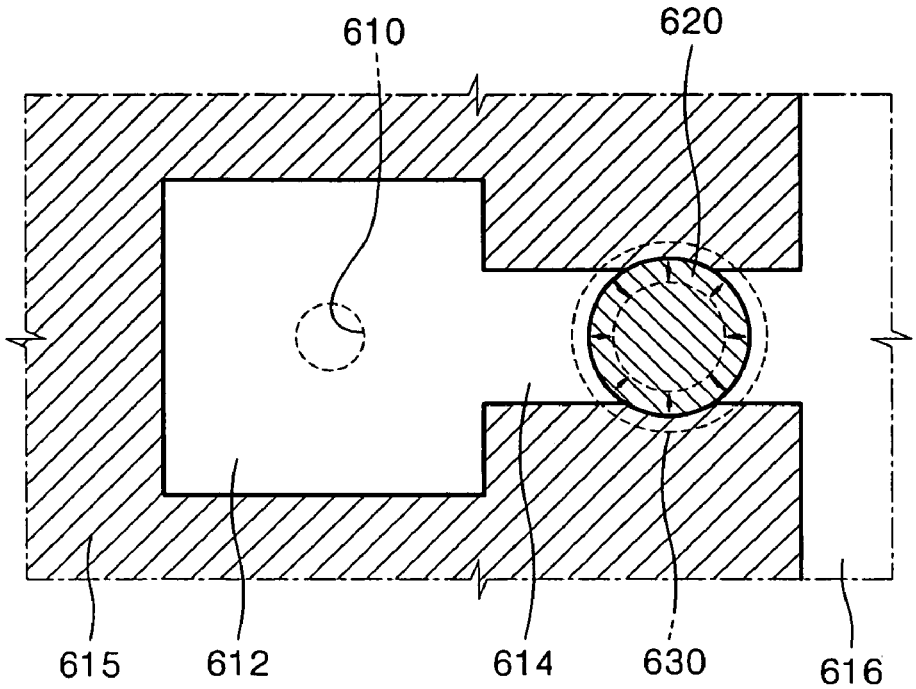

FIGS. 21 and 22 respectively illustrate a cross-sectional view and a plan view of a structure of an ink-jet printhead according to a sixth embodiment of the present invention.

Referring to FIGS. 21 and 22, the ink-jet printhead includes a substrate 600, a barrier layer 615, a nozzle plate 625, a volumetric structure 620, and a resistance heating material 630.

A silicon wafer that is widely used to manufacture integrated circuits (ICs) may be used as the substrate 600. A manifold 616 for supplying ink is formed on the substrate 600. The manifold 616 is in communication with an ink reservoir (not shown) in which ink is stored.

A barrier layer 615 is formed on the substrate 600, and an ink chamber 612 to be filled with ink to be ejected and an ink channel 614 for providing communication between the ink chamber 612 and the manifold 616 are formed on the barrier layer 615. Here, the ink channel 614 is a path through which ink is supplied from the manifold 616 to the ink chamber 614.

Although only an exemplary unit structure of the ink-jet printhead is shown, in an ink-jet printhead manufactured in a chip state, a plurality of ink chambers may be disposed in one row or two rows, or may be disposed in three or more rows to improve printing resolution.

The volumetric structure 620 that contracts when a stimulus is applied thereto is formed in the ink channel 614. In the sixth embodiment, the volumetric structure 620 is formed of temperature sensitive hydrogel, which is a material that contracts if heat is applied to the volumetric structure 620.

Although the volumetric structure 620 has a columnar shape, the volumetric structure 620 may alternately have a hexahedral shape.

The resistance heating material 630 for applying heat to the volumetric structure 620 is formed between the substrate 600 and the barrier layer 615. In FIGS. 21 and 22, the resistance heating material 630 is disposed below the volumetric structure 620. Alternately, the resistance heating material 630 may be disposed at another location near the volumetric structure 620, and a plurality of resistance heating materials may be included. Although not shown, a conductor for applying a voltage is connected to the resistance heating material 630.

In addition, a first insulating layer 602 is formed between the resistance heating material 630 and the substrate 600. A second insulating layer 604 for providing passivation and insulation of the resistance heating material 630 is formed between the resistance heating material 630 and the volumetric structure 620.

A nozzle plate 625 formed of a third insulating layer 623 and a metallic plate 624 is stacked on the barrier layer 615. A nozzle 610 is formed in a position of the nozzle plate 625, which corresponds to a center of the ink chamber 612. The nozzle 610 has a tapered shape such that a diameter thereof decreases as the nozzle 610 extends toward an outlet.

In the above structure, when a voltage is applied to the resistance heating material 630 and heat is generated in the resistance heating material 630, the temperature of the volumetric structure 620 increases, and the volumetric structure 620 contracts. As the volumetric structure 620 contracts, ink flows from the ink reservoir (not shown) through the ink channel 614, and ink is ejected in droplet form through the nozzle 610. Subsequently, when the voltage applied to the resistance heating material 630 is removed, the temperature of the volumetric structure 620 is reduced, and the volumetric structure 620 expands and is restored to the original state.

Hereinafter, a method for manufacturing the above-described ink-jet printhead will be described.

First, the first insulating layer 602, the resistance heating material 630, and the second insulating layer 604 are formed on the substrate 600.

Next, the manifold 616 to provide communication with an ink reservoir (not shown) is formed on the substrate 600.

Subsequently, the barrier layer 615 is stacked above the substrate 600, and then, the ink chamber 612 and the ink channel 614 are formed on the barrier layer 615. In this case, the ink channel 614 is in communication with the manifold 616.

Next, the volumetric structure 620 is formed in the ink channel 614. Specifically, a liquid pre-hydrogel mixture is filled in the ink chamber 612, the ink channel 614, and the manifold 616, and light, for example, ultraviolet rays, is irradiated onto the liquid pre-hydrogel mixture through the photomask. Next, unpolymerized mixture liquid is removed such that the volumetric structure 620 having a desired shape and size is formed in the ink chamber 614.

Last, the nozzle plate 625 formed of the third insulating layer 623 and the metallic plate 624 is stacked on the barrier layer 615, and then, the nozzle 610 is formed. The nozzle 610 is in communication with the ink chamber 612.

As above, the ink-jet printhead has a structure in which a volumetric structure is formed in an ink channel. As respectively shown in FIGS. 23 and 24, the volumetric structure may be formed in either the nozzle or the ink chamber.

Figure 23:
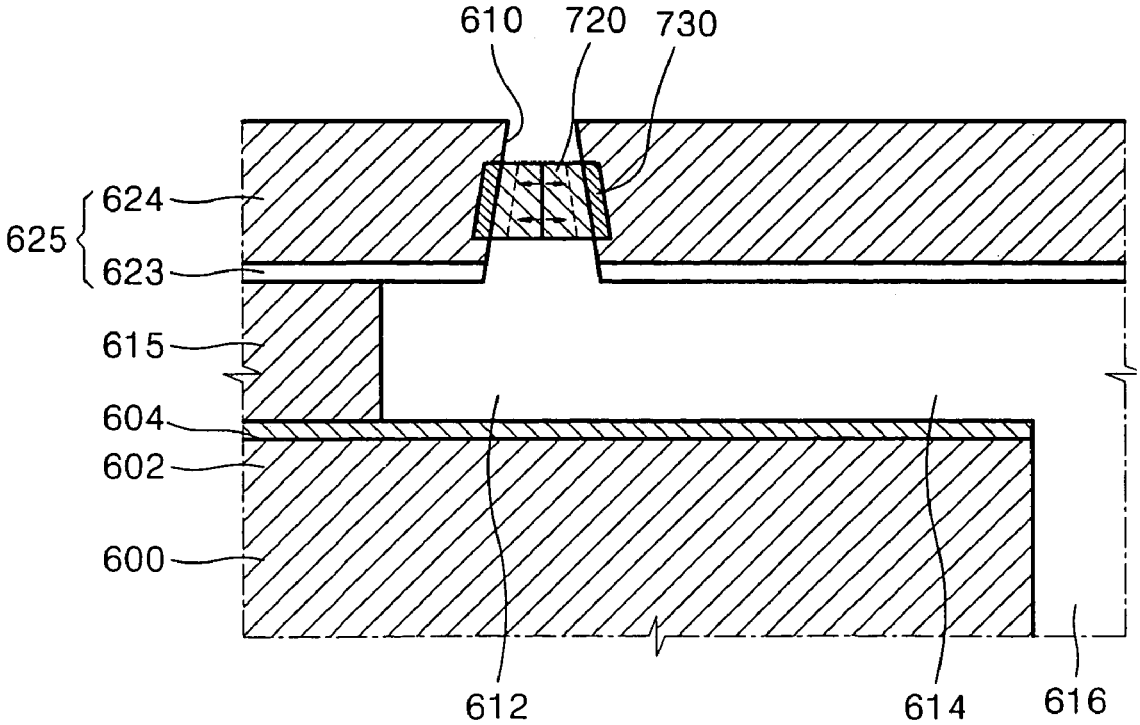
FIG. 23 illustrates a cross-sectional view of a structure of an ink-jet printhead using a droplet ejector according to a seventh embodiment of the present invention.

First, referring to FIG. 23, in a seventh embodiment of the present invention, a volumetric structure 720 is formed along an inner wall of the nozzle 610, and a resistance heating material 730 is disposed to surround the volumetric structure 720. In a state where no voltage is applied to the resistance heating material 730, the volumetric structure 720 expands and closes the nozzle 610. However, when heat is generated in the resistance heating material 730, the volumetric structure 720 contracts in a direction as illustrated by arrows. As such, ink droplets are ejected through a through hole formed in a center of the volumetric structure 720.

Figure 24:
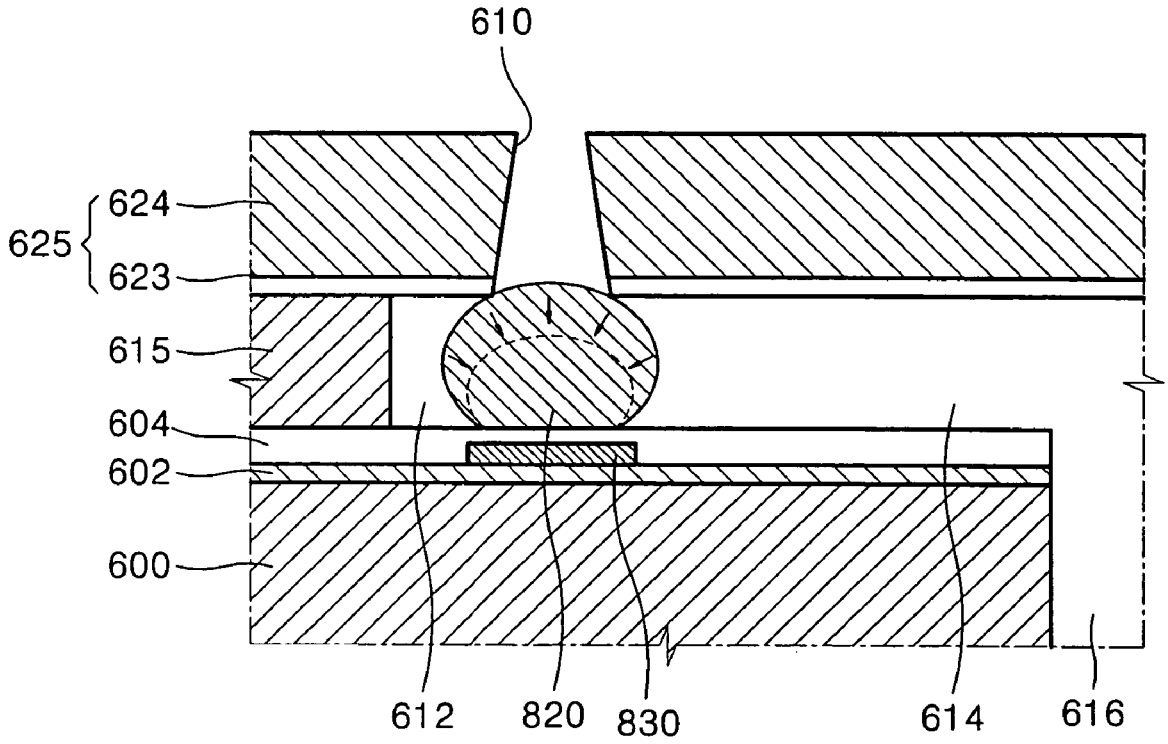
FIG. 24 illustrates a cross-sectional view of a structure of an ink-jet printhead using a droplet ejector according to an eighth embodiment of the present invention.

Next, referring to FIG. 24, in an eighth embodiment of the present invention, a volumetric structure 820 is formed in the ink chamber 612, and a resistance heating material 830 is disposed below the volumetric structure 820. When no voltage is applied to the resistance heating material 830, the volumetric structure 820 expands and closes the nozzle 610. However, when heat is generated in the resistance heating material 830, the volumetric structure 820 contracts in a direction as illustrated by arrows. As such, the nozzle 610 is opened, and ink droplets are ejected through the nozzle 610.

As described above, the droplet ejector and the ink-jet printhead using the same according to the present invention have the following advantageous effects. First, the droplet ejector and the ink-jet printhead can be driven within a low temperature range of about 15-30° C., such that a lowering of an energy efficiency and a dissipating of a remaining thermal energy do not occur in a thermally driven ink-jet printhead. Second, the droplet ejector and the ink-jet printhead have a simple structure, and the size thereof decreases, such that a nozzle becomes highly integrated. Third, the composition of a material of a volumetric structure or stimulus conditions are adjusted, thereby varying a volume variation amount such that the size of ejected droplets is actively controlled. Fourth, the position, size, and volume expansion ratio of the volumetric structure are properly adjusted, such that backflow during droplet ejection is reduced and a driving force is effectively utilized toward a nozzle. Fifth, if stimulus sensitive hydrogel is used as the material of the volumetric structure, a temperature, an electrical field, and light are selected using an external stimulus to cause a volume variation, such that a variety of driving methods are used. Sixth, the volumetric structure is formed in a chamber by a general semiconductor device process, such that a manufacturing process is simplified.

Exemplary embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A droplet ejector, comprising:

a fluid path through which a fluid moves, a nozzle being formed on one end of the fluid path;

a volumetric structure having a predetermined volumetric size, the predetermined volumetric size being contained entirely within the fluid path, the volumetric structure being sensitive to an external stimulus and being capable of varying the predetermined volumetric size in at least two directions simultaneously to eject a droplet of the fluid through the nozzle; and a stimulus generator configured to generate and apply the stimulus to the volumetric structure to vary the predetermined volumetric size of the volumetric structure and to remove the stimulus to adjust the volumetric structure to the predetermined volumetric size, wherein the droplet ejector is configured to eject the droplet of fluid upon application of the stimulus.

2. The droplet ejector as claimed in claim 1, wherein the volumetric structure expands in size to eject the droplet through the nozzle, and the stimulus generator applies the stimulus to the volumetric structure to expand the size of the volumetric structure.

3. The droplet ejector as claimed in claim 2, wherein the volumetric structure is formed of stimulus sensitive hydrogel.

4. The droplet ejector as claimed in claim 3, wherein the stimulus sensitive hydrogel is electrical field sensitive hydrogel.

5. The droplet ejector as claimed in claim 1, wherein the fluid path comprises:

a chamber, which is filled with the fluid to be ejected and is formed under the nozzle; and a channel for supplying the fluid to the chamber, wherein the volumetric structure is formed in the chamber.

6. The droplet ejector as claimed in claim 5, wherein the volumetric structure has a columnar shape, a hexahedral shape, or a cylindrical shape.

7. The droplet ejector as claimed in claim 5, wherein the stimulus generator is a pair of electrodes respectively disposed above and below the volumetric structure.

8. The droplet ejector as claimed in claim 5, wherein the stimulus generator is a pair of electrodes respectively disposed at either side of the volumetric structure.

9. The droplet ejector as claimed in claim 1, wherein the volumetric structure contracts in size to eject the droplet through the nozzle, and the stimulus generator applies the stimulus to the volumetric structure to contract the size of the volumetric structure.

10. The droplet ejector as claimed in claim 9, wherein the volumetric structure is formed of stimulus sensitive hydrogel.

11. The droplet ejector as claimed in claim 10, wherein the stimulus sensitive hydrogel is temperature sensitive hydrogel.

12. The droplet ejector as claimed in claim 11, wherein the stimulus generator is a resistance heating material for applying heat to the volumetric structure.

13. The droplet ejector as claimed in claim 12, wherein the fluid path comprises:

a chamber, which is filled with the fluid to be ejected and is formed under the nozzle; and a channel for supplying the fluid to the chamber.

14. The droplet ejector as claimed in claim 13, wherein the volumetric structure is formed in the channel.

15. The droplet ejector as claimed in claim 14, wherein the volumetric structure has a columnar shape or a hexahedral shape.

16. The droplet ejector as claimed in claim 13, wherein the volumetric structure is formed in the nozzle.

17. The droplet ejector as claimed in claim 13, wherein the volumetric structure is formed in the chamber.

18. The droplet ejector as claimed in claim 1, wherein the volumetric structure exhibits a non-isotropic variation in size upon application of the stimulus.

19. The droplet ejector as claimed in claim 18, wherein the stimulus generator includes a pair of electrodes, one of the pair of electrodes being a cathode, the volumetric structure is an electrical field sensitive hydrogel that varies in volume towards the cathode first, and the cathode is disposed between the volumetric structure and the nozzle.

20. The droplet ejector as claimed in claim 1, wherein the volumetric structure is on a surface that defines a portion of the fluid path, and the two directions are orthogonal to each other.

21. The droplet ejector as claimed in claim 20, wherein the volumetric structure has a first end disposed on the surface that defines a portion of the fluid path, a second end opposite to the first end and a side portion connecting the first and second ends, and wherein the side portion and the second end are exposed to the fluid.

22. The droplet ejector as claimed in claim 1, wherein the volumetric structure is configured to expand to a size greater than its original size.

23. The droplet ejector as claimed in claim 1, wherein the volumetric structure is configured to contract to its original size.

24. An ink-jet printhead, comprising:

a manifold on a substrate;

a barrier layer on the substrate;

a nozzle plate on the barrier layer, the nozzle plate including a nozzle;

an ink chamber between the barrier layer and the nozzle plate;

an ink channel on the barrier layer and in communication with the ink chamber and the manifold;

a volumetric structure in communication with an ink flow, the volumetric structure being sensitive to an external stimulus and being capable of varying in size to eject the ink droplet through the nozzle, the volumetric structure being formed of stimulus sensitive hydrogel; and a stimulus generator, which applies a stimulus to the volumetric structure to vary a size of the volumetric structure.

25. The ink-jet printhead as claimed in claim 24, wherein the volumetric structure expands in size to eject the ink droplet through the nozzle, and the stimulus generator applies the stimulus to the volumetric structure to expand the size of the volumetric structure.

26. The ink-jet printhead as claimed in claim 25, wherein the stimulus sensitive hydrogel is electrical field sensitive hydrogel.

27. The ink-jet printhead as claimed in claim 26, wherein the volumetric structure is formed in the ink chamber.

28. The ink-jet printhead as claimed in claim 27, wherein the volumetric structure has a columnar shape, a hexahedral shape, or a cylindrical shape.

29. The ink-jet printhead as claimed in claim 27, wherein the stimulus generator is a pair of electrodes respectively disposed above and below the volumetric structure.

30. The ink-jet printhead as claimed in claim 29, wherein one of the pair of electrodes is a cathode and is disposed above the volumetric structure.

31. The ink-jet printhead as claimed in claim 27, wherein the stimulus generator is a pair of electrodes respectively disposed at either side of the volumetric structure.

32. The ink-jet printhead as claimed in claim 24, wherein the volumetric structure contracts in size to eject the ink droplet through the nozzle, and the stimulus generator applies the stimulus to the volumetric structure to contract the size of the volumetric structure.

33. The ink-jet printhead as claimed in claim 32, wherein the stimulus sensitive hydrogel is temperature sensitive hydrogel.

34. The ink-jet printhead as claimed in claim 33, wherein the stimulus generator is a resistance heating material for applying heat to the volumetric structure.

35. The ink-jet printhead as claimed in claim 34, wherein the volumetric structure is formed in the ink channel.

36. The ink-jet printhead as claimed in claim 35, wherein the volumetric structure has a columnar shape or a hexahedral shape.

37. The ink-jet printhead as claimed in claim 34, wherein the volumetric structure is formed in the nozzle.

38. The ink-jet printhead as claimed in claim 34, wherein the volumetric structure is formed in the ink chamber.

* * * * *